US010253597B2

(12) United States Patent
Hardesty et al.

(10) Patent No.: US 10,253,597 B2
(45) **Date of Patent: *Apr. 9, 2019**

(54) DEGRADABLE MATERIAL TIME DELAY SYSTEM AND METHOD

(71) Applicant: GEODynamics, Inc., Millsap, TX (US)

(72) Inventors: John T Hardesty, Weatherford, TX (US); Dennis Roessler, Fort Worth, TX (US); Kevin R George, Cleburne, TX (US)

(73) Assignee: GEODYNAMICS, INC., Millsap, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/053,534

(22) Filed: Feb. 25, 2016

(65) Prior Publication Data

US 2017/0247977 A1 Aug. 31, 2017

Related U.S. Application Data

(63) Continuation of application No. 15/053,417, filed on Feb. 25, 2016.

(51) Int. Cl.

| | |
|---|---|
| ***E21B 43/1185*** | (2006.01) |
| ***E21B 41/00*** | (2006.01) |
| ***E21B 34/14*** | (2006.01) |
| ***E21B 34/06*** | (2006.01) |
| ***E21B 33/12*** | (2006.01) |

(52) U.S. Cl.
CPC ..... *E21B 41/00* (2013.01); *E21B 33/12* (2013.01); *E21B 34/06* (2013.01); *E21B 34/063* (2013.01); *E21B 34/14* (2013.01); *E21B 43/1185* (2013.01); *E21B 43/11852* (2013.01)

(58) Field of Classification Search
CPC ..... E21B 34/063
See application file for complete search history.

(56) References Cited

U.S. PATENT DOCUMENTS 3,010,515 A * 11/1961 Harrison ..... E21B 29/02 166/54.5
4,429,741 A 2/1984 Hyland
(Continued)

OTHER PUBLICATIONS

TC-Hookups-0.5, Owen Oil Tools—Core Laboratories, Nov. 2007, Revision 2, 15 pages.

(Continued)

*Primary Examiner* — D. Andrews
(74) *Attorney, Agent, or Firm* — Patent Portfolio Builders PLLC

(57) ABSTRACT

A time delay tool and method includes a mechanical restraining element, a reservoir for containing a reactive fluid, an actuating device and a wellbore device. When a stored energy is applied on the wellbore device, the actuation device is actuated and enables the reactive fluid in the reservoir to come in contact with the mechanical restraining element. While the mechanical restraining element undergoes a change in shape due to a chemical reaction, a stored energy applied on the wellbore device is delayed by a pre-determined time delay. The amount of the pre-determined time delay is determined by factors that include the reactive fluids, concentration of the reactive fluids, geometry and size of the mechanical restraining element.

17 Claims, 22 Drawing Sheets

(56) References Cited

U.S. PATENT DOCUMENTS

| | | | | |
|---|---|---|---|---|
| 4,474,242 | A * | 10/1984 | Upchurch | E21B 49/001 166/323 |
| 4,614,156 | A * | 9/1986 | Colle, Jr. | E21B 43/116 102/275.11 |
| 5,115,865 | A * | 5/1992 | Carisella | F42D 1/04 166/297 |
| 5,301,755 | A | 4/1994 | George et al. | |
| 6,176,323 | B1 * | 1/2001 | Weirich | E21B 21/08 175/40 |
| 8,579,036 | B2 * | 11/2013 | Xu | E21B 43/26 166/318 |
| 2001/0054514 | A1 | 12/2001 | Sullivan et al. | |
| 2008/0066923 | A1 | 3/2008 | Xu | |
| 2010/0108311 | A1 * | 5/2010 | Daussin | E21B 47/065 166/250.01 |
| 2010/0230105 | A1 | 9/2010 | Vaynshteyn | |
| 2010/0270031 | A1 * | 10/2010 | Patel | E21B 33/1208 166/376 |
| 2011/0132608 | A1 | 6/2011 | Busaidy et al. | |
| 2014/0096970 | A1 | 4/2014 | Andrew et al. | |
| 2015/0247084 | A1 | 9/2015 | Epstein | |
| 2015/0275616 | A1 | 10/2015 | Epstein | |
| 2016/0047193 | A1 | 2/2016 | Snider et al. | |
| 2016/0201425 | A1 | 7/2016 | Walton et al. | |

OTHER PUBLICATIONS

ISA/US, International Search Report and Written Opinion for PCT/US2017/014622 dated Apr. 4, 2017.

ISA/US, International Search Report and Written Opinion for PCT/US2017/014613 dated Apr. 4, 2017.

Office Action in U.S. Appl. No. 15/220,042 dated Mar. 14, 2018.

Office Action in related U.S. Appl. No. 15/220,042 dated Jun. 19, 2018.

* cited by examiner

DEGRADABLE MATERIAL TIME DELAY SYSTEM AND METHOD

CROSS REFERENCE TO RELATED APPLICATIONS

This application is a continuation of U.S. application Ser. No. 15/053,417, filed Feb. 25, 2016, the disclosure of which is fully incorporated herein by reference.

FIELD OF THE INVENTION

The present invention generally relates to downhole wellbore tools. Specifically, the invention attempts to utilize a known fluid that reacts with a degradable mechanical element permitting a known time delay between a trigger event and a functional event.

PRIOR ART AND BACKGROUND OF THE INVENTION

Prior Art Background

In oil and gas extraction applications, there is a need to have a certain length of time delay between pressure triggered events such that the system can be tested at a pressure before the next event could proceed. This system cannot be controlled with any other means besides the application of pressure. Prior art system means of fluid restriction uses a complex system of microscopic passages that meter fluid. Therefore, there is a need for non-expensive simple and flexible component flow restriction systems.

Inside a tandem in a gun string assembly, a transfer happens between the detonating cords to detonate the next gun in the daisy chained gun string. Detonation can be initiated from the wireline used to deploy the gun string assembly either electrically, pressure activated or by electronic means. In tubing conveyed perforating (TCP) as there is no electric conductor, pressure activated percussion initiation is used to detonate. TCP is used to pump up to a tubing pressure that reaches a certain pressure enabling a firing head to launch a firing pin. Subsequently, the firing pin starts the percussion initiator which starts the detonation cord. There is a need to delay the launching of a firing pin by a predetermined time in certain instances so that tests can be conducted or a hang fire condition may be detected on a previous gun.

In tandem systems there is a single detonating cord passing through the guns. There are no pressure barriers. However, in select fire systems (SFS) there is a pressure isolation switch between each gun. Each gun is selectively fired though its own detonation train. A detonator feeds off each switch. When the lower most perforating gun is perforated, pressure enters the inside of the gun. When the first gun is actuated, the second detonator gets armed when the pressure in the first gun switch moves into the next position actuating a firing pin to enable detonation in the next gun. All guns downstream are isolated from the next gun by the pressure barrier.

Spool valves are directional control valves that are used as wellbore tools. They allow fluid flow into different paths from one or more sources. They usually consist of a spool inside a cylinder which is mechanically or electrically controlled. The movement of the spool restricts or permits the flow, thus it controls the fluid flow. There are two fundamental positions of directional control valve namely normal position where valve returns on removal of actuating force and other is working position which is position of a valve when actuating force is applied. However, prior art spool valves do not have a control mechanism with a pre-determined delay to switch from normal position to a working position.

It is known that well fluids vary in the chemical nature and are not always the same composition. However, the temperature of the well is often defined or can be manipulated to achieve a pre-determined temperature. Most time delay elements currently used comprise complex mechanisms and are often expensive. Therefore, there is a need for a time delay tool that can use a known fluid or an unknown fluid inside a well at a known temperature such that a known degradable element can react and degrade in the known fluid at the known temperature for a known amount of time so that a pre-determined time may be achieved to trigger a mechanism in a device.

Deficiencies in the Prior Art

The prior art as detailed above suffers from the following deficiencies:

- Prior art systems do not provide for a known degradable element that can react and degrade in a known fluid at a known temperature for a known amount of time so that a pre-determined time may be achieved to trigger a mechanism in a device.
- Prior art systems do not provide for a low cost configurable time delay flow restriction element that is commonly available.
- Prior art systems do not provide for a predictable time delay.
- Prior art systems do not provide for a cost effective time delay solution that are independent of the wellbore fluids.
- Prior art systems require bulky and expensive hydraulics.
- Prior art systems require expensive electronics that have difficulty functioning at downhole temperatures.

While some of the prior art may teach some solutions to several of these problems, the core issue of a predictable time delay with known fluids at pre-determined temperatures has not been addressed by prior art.

BRIEF SUMMARY OF THE INVENTION

System Overview

The present invention in various embodiments addresses one or more of the above objectives in the following manner. The tool includes a mechanical restraining element, a reservoir for containing a reactive fluid, an actuating device and a wellbore device. When a stored energy is applied on the wellbore device, the actuation device is actuated and enables the reactive fluid in the reservoir to come in contact with the mechanical restraining element. While the mechanical restraining element undergoes a change in shape or strength due to a chemical reaction, a stored energy applied on the wellbore device is delayed by a pre-determined time delay. The amount of the pre-determined time delay is determined by factors that include the reactive fluids, concentration of the reactive fluids, geometry and size of the mechanical restraining element.

Method Overview

The present invention system may be utilized in the context of an overall time delay method, wherein the downhole wellbore time delay tool as previously described is controlled by a method having the following steps:

(1) positioning the wellbore tool at desired wellbore location;
(2) applying stored energy on the wellbore device;
(3) actuating the actuating device and enabling fluid communication between the mechanical restraining element and the reactive fluid;
(4) initiating a chemical reaction between the mechanical restraining element and the reactive fluid;
(5) progressing the chemical reaction for a pre-determined time delay and altering size of the mechanical restraining element;
(6) releasing restraint by the mechanical restraining element; and
(7) triggering a movement in the wellbore device.

Integration of this and other preferred exemplary embodiment methods in conjunction with a variety of preferred exemplary embodiment systems described herein in anticipation by the overall scope of the present invention.

BRIEF DESCRIPTION OF THE DRAWINGS

For a fuller understanding of the advantages provided by the invention, reference should be made to the following detailed description together with the accompanying drawings wherein.

OBJECTIVES OF THE INVENTION

Figure 1:
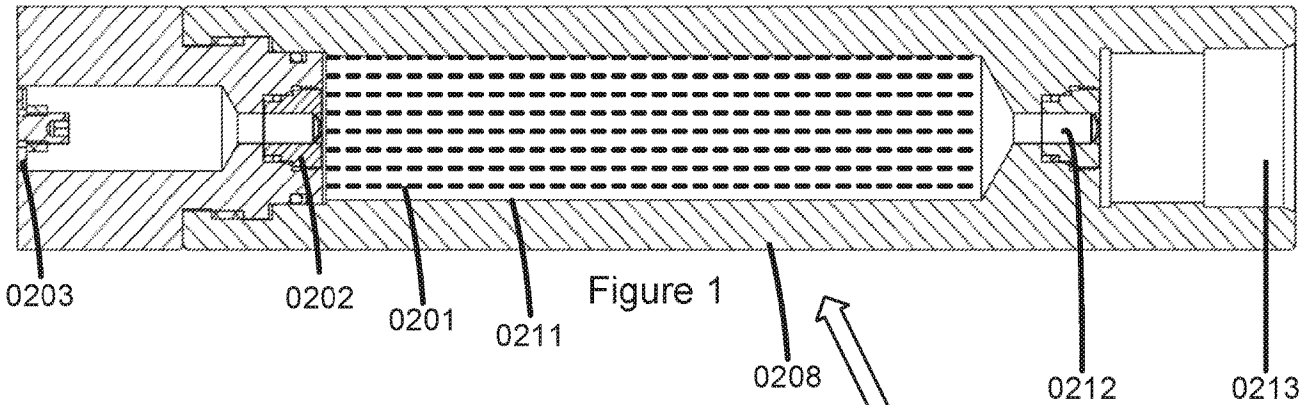
FIG. 1 illustrates a cross-section overview diagram of downhole wellbore time delay tool according to an exemplary embodiment of the present invention.

Accordingly, the objectives of the present invention are (among others) to circumvent the deficiencies in the prior art and affect the following objectives:

- Provide for a known degradable element that can react and degrade in a known fluid at a known temperature for a known amount of time so that a pre-determined time may be achieved to trigger a mechanism in a device.
- Provide for a low cost configurable time delay flow restriction element that is commonly available.
- Provide for a predictable time delay.
- Provide for a cost effective time delay solution that is independent of the wellbore fluids.
- Provide for a tubing conveyed perforating gun with a delay mechanism which provides a known delay interval between pressuring the tubing to a second predetermined level and the actual firing of the perforating gun.
- Provide for a delay means to move a firing pin holder out of locking engagement with a firing pin, to release firing pin, after a predetermined time interval.
- Provide for portable and inexpensive hydraulics for a time delay tool.
- Provide for an inexpensive time delay tool that functions reliably at downhole temperatures.

Provide for a time delay tool suitable for wireline conveyed, coil tubing conveyed, casing conveyed or pump down.

While these objectives should not be understood to limit the teachings of the present invention, in general these objectives are achieved in part or in whole by the disclosed invention that is discussed in the following sections. One skilled in the art will no doubt be able to select aspects of the present invention as disclosed to affect any combination of the objectives described above.

Description of the Presently Preferred Exemplary Embodiments

While this invention is susceptible of embodiment in many different forms, there is shown in the drawings and will herein be described in detailed preferred embodiment of the invention with the understanding that the present disclosure is to be considered as an exemplification of the principles of the invention and is not intended to limit the broad aspect of the invention to the embodiment illustrated.

The numerous innovative teachings of the present application will be described with particular reference to the presently preferred embodiment, wherein these innovative teachings are advantageously applied to the particular problems of a hydraulic time delay system and method. However, it should be understood that this embodiment is only one example of the many advantageous uses of the innovative teachings herein. In general, statements made in the specification of the present application do not necessarily limit any of the various claimed inventions. Moreover, some statements may apply to some inventive features but not to others.

Preferred Exemplary Downhole Wellbore Time Delay Tool Integrated into an Energetic Device (0200-0600)

Figure 2:
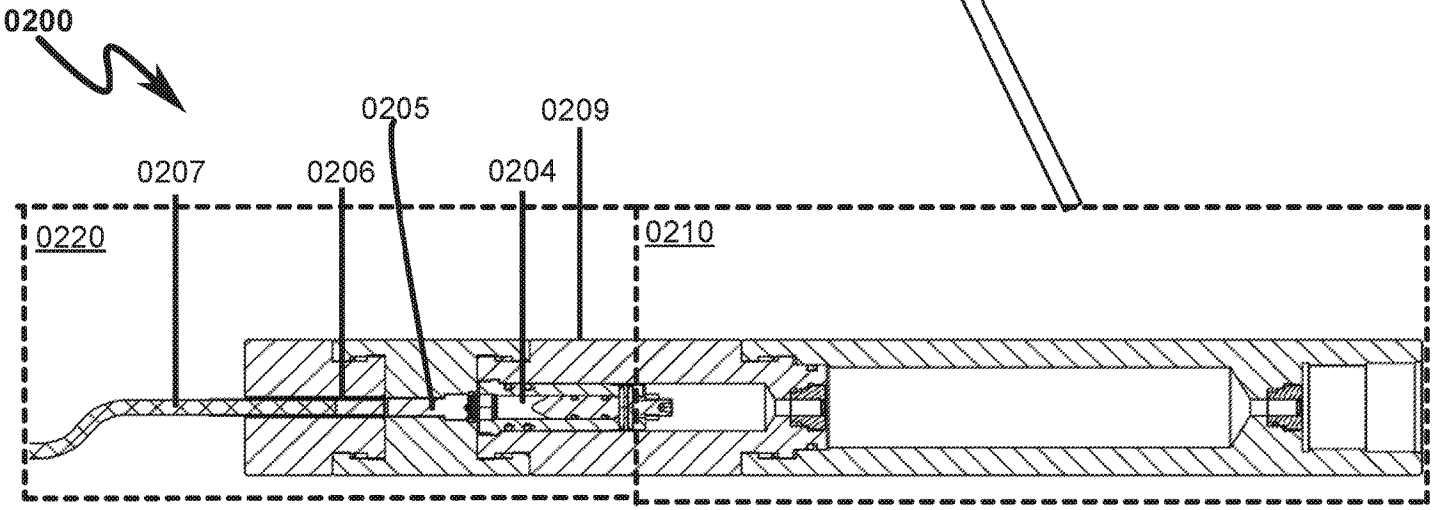
FIG. 2 illustrates a cross-section overview diagram of downhole wellbore time delay tool with an energetic device and a firing pin according to an exemplary embodiment of the present invention.

As generally illustrated in FIG. 1 and FIG. 2 (0200), a downhole wellbore time delay tool (0210) for use in a wellbore casing comprises a reservoir (0211) for containing a reactive fluid (0201), an actuating device (0202) such as a rupture disk, a mechanical restraining element (0203) such as a nut and mechanically connected to a wellbore device such as an energetic device (0220) with firing pin (0204), a percussion initiator (0205), a booster (0206) and a detonating cord (0207). A detailed view of the wellbore tool (0210) is illustrated in FIG. 1. The entire tool (0200) may be piped into the casing string as an integral part of the string and positioned where functioning of the tool is desired or the tool may be deployed to the desired location with TCP, CT or a wire line. The wellbore may be cemented or not. The fluid in the reservoir (0211) is held at an initial position by the actuating device (0202), such as a rupture disk. The tool mandrel is machined to accept the actuating device (0202) (such as rupture discs) that ultimately controls the flow of reactive fluid (0201). The fluid reservoir (0211) may be further installed in within a fluid holding body (0208). The fluid holding body (0208) may be operatively connected to a body (0209) of the energetic device (0220). In one embodiment, the rated pressure of the actuating device may range from 500 PSI to 15000 PSI.

The reservoir (0211) may be in fluid communication with the mechanical restraining element via the actuation device (0202). Alternatively, the reactive fluid may be directly in fluid communication with the mechanical restraining element via the actuation device (0202) without a reservoir. For example, the mechanical restraining element may not be in fluid communication initially with any fluid. When the pressure in the wellbore casing increases to actuate the actuating device, wellbore fluids may enter and react with the mechanical restraining element. It should be noted that the reservoir to contain a reactive fluid may not be construed as a limitation. A pressure port (0213) may be attached to another end of the reservoir through another actuating device (0212). The reservoir (0211) may be a holding tank that may be positioned inside a fluid holding body (0208) of a well casing. The volume of the reservoir may range from 25 ml to 5 liters. The material of the reservoir may be chosen so that the reactive fluid inside the reservoir does not react with the material of the reservoir and therefore does not corrode or erode the reservoir (0211). According to a preferred exemplary embodiment, the material of the reservoir may be selected from a group comprising: metal, ceramic, plastic, degradable, long term degradable, glass, composite or combinations thereof. The reservoir may also be pressurized so that there is sufficient flow of the reactive fluid towards the restraining element. The actuation device (0202) may be a reverse acting rupture disk that blocks fluids communication between the reactive fluid and the restraining element. The actuation device (0212) ruptures or actuates when a pressure in the wellbore through the pressure port (0213) exceeds a rated pressure of the actuating device (0212). After the actuating device (0212) rupture, the pressure acting through the pressure port (0213) may act on the fluid which further acts on the actuating device (0202). When the pressure of the fluid acting on the actuation device (0202) exceeds a rated pressure of the actuating device (0202), the reactive fluid (0201) flows through and enters a chamber and comes in contact with the restraining element (0203). According to another preferred exemplary embodiment the actuating device is an electronic switch that is actuated by a signal from a device storing a stored energy.

The pressure on the actuation device (0202) may be ramped up to the rated pressure with pressure from the reactive fluid. The reactive fluid (0201) is configured to react with the mechanical restraining element (0203) at a temperature expected to be encountered in the wellbore. According to a preferred exemplary embodiment a physical property change in the restraining element may occur at a pre-determined temperature expected to be encountered in the wellbore casing. According to a further preferred exemplary embodiment the pre-determined temperature ranges from 25° C.-250° C. The mechanical restraining element (0203) may be a nut, a shear pin, or a holding device that degrades as the reaction takes place. Upon further degradation, the mechanical restraining element (0203) may release a restraint on the energetic device (0220) and enable the entire pressure or stored energy to act on an end of the energetic device (0220).

According to a preferred exemplary embodiment the reactive fluid is selected from a group comprising: fresh water, salt water, KCL, NaCl, HCL, or hydrocarbons.

The energetic device (0220) may be operatively connected to the mechanical restraining element via threads, seals or a connecting element. The tool mandrel may be machined to accept the wellbore reservoir, the actuating device and the wellbore device such as a firing pin assembly. In some instances, the mechanical restraining element may be a nut that may be screwed or attached to a counterpart in the wellbore device. In other instances the restraining element may be a tensile member. The wellbore device may be an energetic device (0220) with a firing pin (0204) as illustrated in FIG. 2 (0200).

According to a preferred exemplary embodiment, when a stored energy, such as a pressure from a fluid, is applied on the firing pin assembly, the actuating device (0202) is actuated and the reactive fluid (0201) from the reservoir (0211) comes into contact with the mechanical restraining element (0203) and enables a physical property change in the mechanical restraining element such that the stored energy applied on the wellbore device is delayed by a pre-determined time delay while the mechanical restraining element undergoes the physical property change. The physical property change may enable the restraining element to change shape for a pre-determined period of time. The physical property may be strength, ductility or elasticity. In tubing conveyed perforating gun with a delay mechanism, a known delay interval between pressuring the tubing to a second pre-determined level and the actual firing of the perforating gun may be achieved by the pre-determined time delay. In a select fire system, a delay means, to move a firing pin holder out of locking engagement with a firing pin to release the firing pin, may be achieved by the predetermined time interval. 5. The firing pin (0204) may contact a percussion detonator/initiator (0205) that connects to a bidirectional booster (0206). The bidirectional booster (0206) may accept a detonation input from the detonator. The detonating cord (0207) may be initiated in turn by the booster (0206). When the firing pin is actuated after the mechanical restraint (0203) is released, the firing pin (0204) may contact a percussion detonator (0205) and in turn initiate a detonator through a booster (0206) and a detonating cord (0207).

According to a preferred exemplary embodiment, the stored energy is applied from a spring. According to another preferred exemplary embodiment, the stored energy is applied from a pressure from a fluid and a seal. According to a further preferred exemplary embodiment, the stored energy is applied from a magnetic field. According to yet another preferred exemplary embodiment, the stored energy is applied from a weight.

According to a preferred exemplary embodiment, the pre-determined time delay ranges from 1 hour to 48 hours. According to a more preferred exemplary embodiment, the pre-determined time delay ranges from 2 days to 14 days. According to a most preferred exemplary embodiment, the pre-determined time delay ranges from 0.01 seconds to 1 hour.

According to a preferred exemplary embodiment, the chemical reaction may be an exothermic reaction that gives off heat. The energy needed to initiate the chemical reaction may be less than the energy that is subsequently released by the chemical reaction. According to another preferred exemplary embodiment, the chemical reaction may be an endothermic reaction that absorbs heat. The energy needed to initiate the chemical reaction may be greater than the energy that is subsequently released by the chemical reaction.

The rate of the chemical reaction may be accelerated or retarded based on factors such as nature of the reactants, particle size of the reactants, concentration of the reactants, pressure of the reactants, temperature and catalysts. According to a preferred exemplary embodiment, a catalyst may be added to alter the rate of the reaction. According to a preferred exemplary embodiment, the material of the restraining element may be selected from a group comprising: mixture of aluminum, copper sulfate, potassium chlorate, and calcium sulfate, iron, magnesium, steel, plastic, degradable, magnesium-iron alloy, particulate oxide of an alkali or alkaline earth metal and a solid, particulate acid or strongly acid salt, or mixtures thereof. The catalyst may be selected from a group comprising salts. According to a preferred exemplary embodiment, the material of the restraining element may be selected from a group comprising: metal, non-metal or alloy.

According to a preferred exemplary embodiment the mechanical restraining element is a restrictive plug element. For example, the restriction plug element may be a ball or a plug that is used to isolate pressure communication between zones or stages in a well casing.

According to a preferred exemplary embodiment the pre-determined time delay is determined by concentration of the reactive fluids. According to another preferred exemplary embodiment the pre-determined time delay is determined by reaction rate of the reactive fluids with the mechanical restraining element. According to yet another preferred exemplary embodiment the pre-determined time delay is determined by reaction time of the reactive fluids with the mechanical restraining element. According to a further preferred exemplary embodiment the pre-determined time delay is determined by masking a contact area of the mechanical restraining element. According to a further preferred exemplary embodiment the pre-determined time delay is determined by masking a total area of the mechanical restraining element in contact with the mechanical restraining element.

According to a preferred exemplary embodiment the shape of the mechanical restraining element is selected from a group comprising: square, circle, oval, and elongated.

A sealed cap may seal the exposed end of the reservoir to physically protect the reservoir from undesired wellbore conditions.

According to an alternate preferred embodiment, a multi stage restraining element comprising a blocking member and a restraining member may further increase a time delay. For example, mechanical restraining element (0203) may be coupled with a blocking member that may have a different composition and reaction time with the fluid in the reservoir. The blocking member may react with the fluid for a period of time and may restrict fluid access to the mechanical restraining element for a pre-determined period of time. It should be noted that the multi stage restraining element may not limited to a blocking member and a restraining element. Any number of blocking members and restraining elements may be used in combination to achieve a desired time delay. The reaction times and therefore the time delays of each of the bonding members with the fluid may be characterized at various temperatures expected in the wellbore.

In another preferred exemplary embodiment, the reservoir may be filled with wellbore fluids. For example, the reservoir may be empty when deployed into the wellbore and later filled with wellbore fluids. A time vs temperature chart for the restraining element may be characterized with different compositions of wellbore fluids expected in the wellbore at temperatures expected in the wellbore casing. Alternatively, the fluid reservoir may be partially filled with the known fluid and wellbore fluids may fill the remaining portion of the reservoir. The reservoir may be filled with the known fluid, wellbore fluids or a combination thereof. The mechanical restraining element may comprise one or more material types that react and have different degradation rates in one or more fluid types. The desired time delay may be achieved with a combination of fluid types and restraining element material types.

Figure 3A:
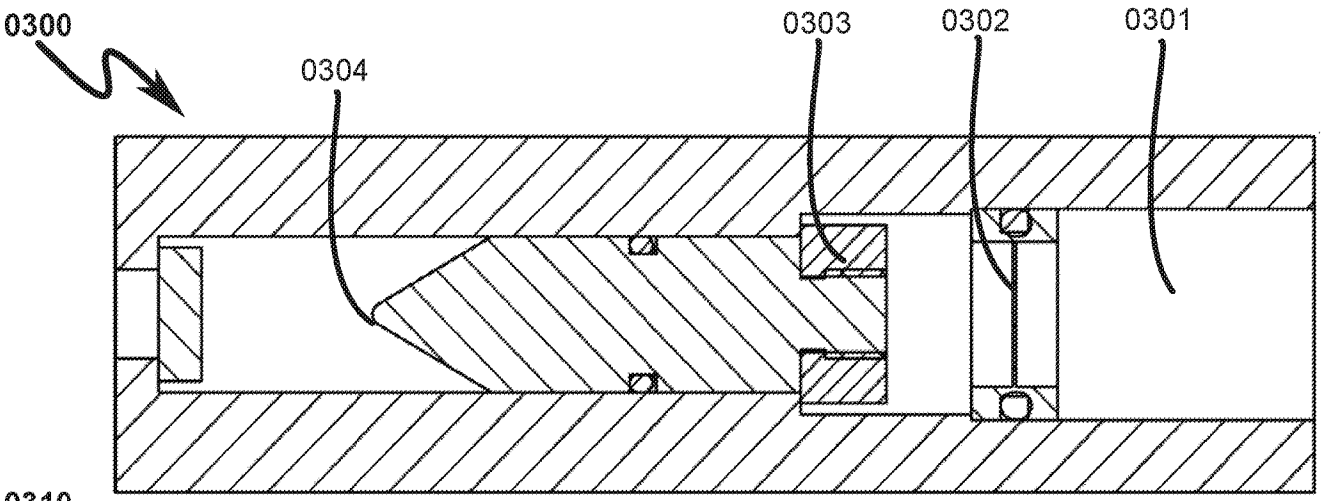
FIGS. 3A-3D illustrates a cross-section view of downhole wellbore time delay tool with an energetic device and a firing pin describing an initial set up, actuation position, a degradation position, and a triggering position according to an exemplary embodiment of the present invention.
Figure 3B:
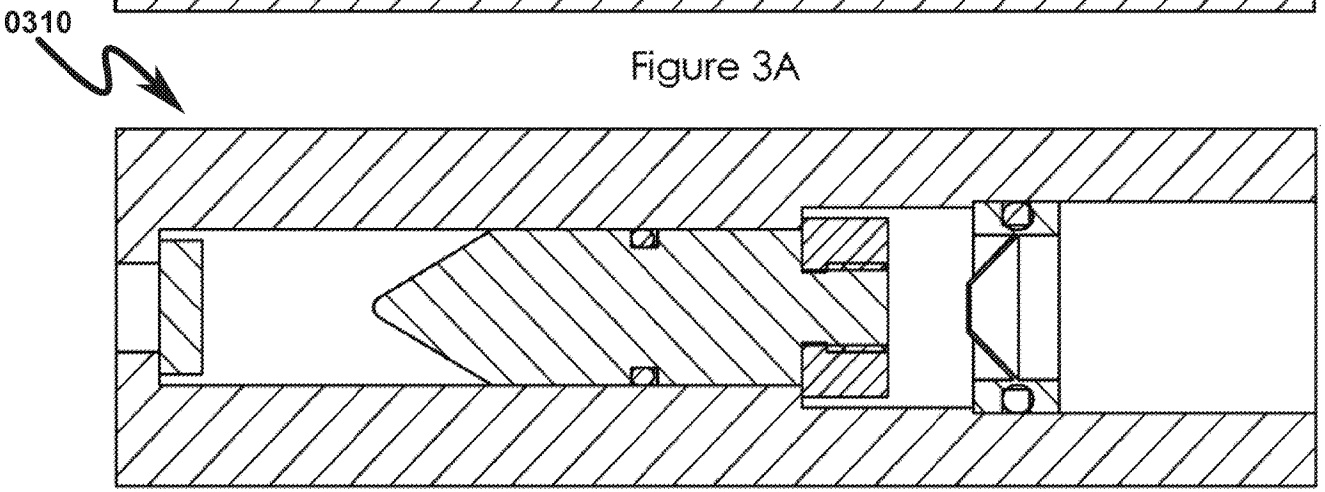
Figure 3C:
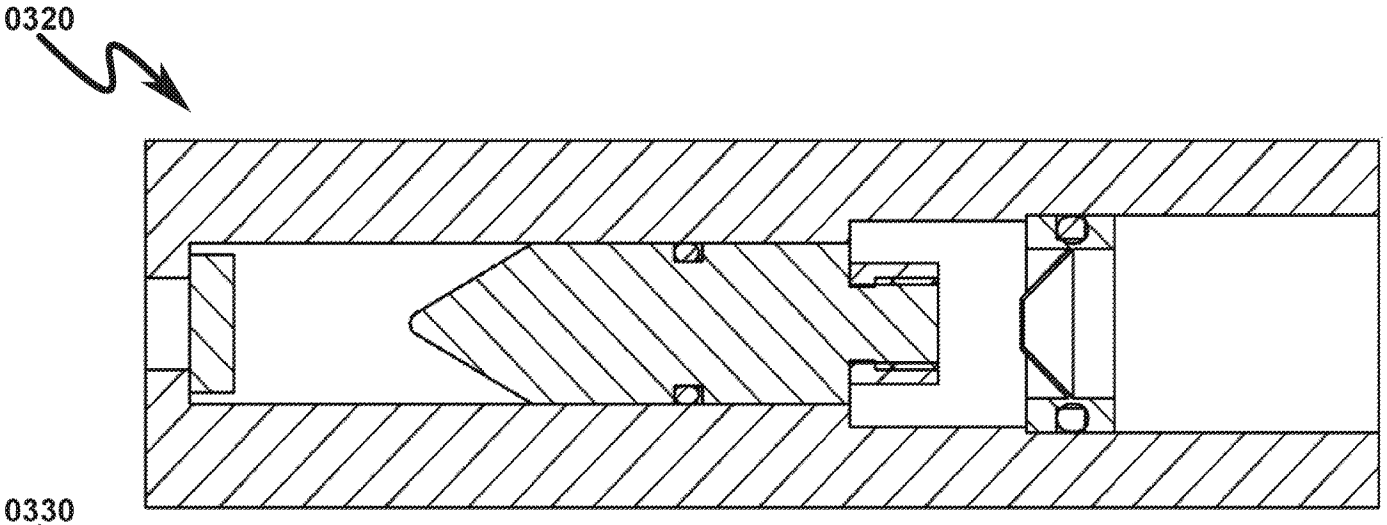
Figure 3D:
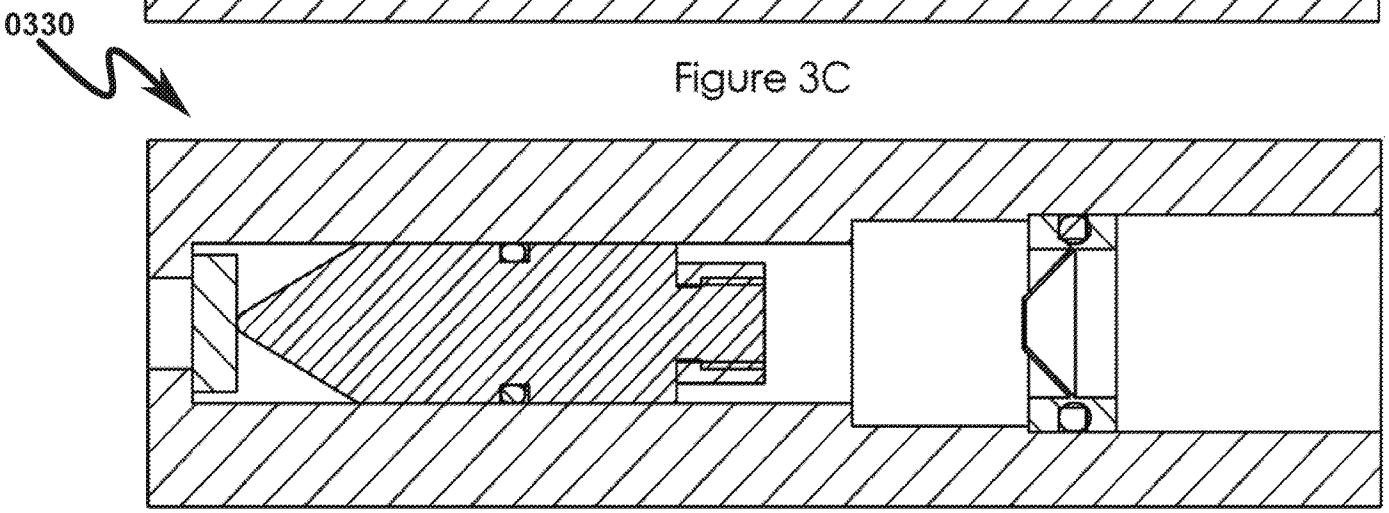

The present exemplary embodiment is generally illustrated in more detail in FIG. 3A (0300), FIG. 3B (0310), FIG. 3C (0320), FIG. 3D (0330), wherein the downhole wellbore delay tool is deployed inside a wellbore casing. FIGS. 3A-3D generally illustrates different positions of a firing pin assembly (0304). The positions include an initial set up position (0300), an actuation position (0310), a degradation position (0320) and a triggering position (0330). The entire tool may be piped into the casing string as an integral part of the string and positioned where functioning of the tool is desired. In one exemplary embodiment, the tool may be a firing pin assembly that is positioned where detonation, perforation of a formation and fluid injection into a formation is desired. The tool may be installed in either direction with no change in its function. A detailed view of the tool in the initial set up position is shown in FIG. 3 (0300) where in the fluid in the reservoir is held by the actuating device (0302). When ready to operate, the pressure is increased for example with TCP. The tool then moves to the actuation position (0310), when pressure acting on the actuating device (0302) exceeds its rated pressure, the actuation device ruptures and enables reactive fluid in the fluid reservoir (0301) to enter the adjacent chamber and contacts the restraining element. Subsequently, after elapse of a pre-determined time delay, the restraining element degrades or changes shape due to the chemical reaction as illustrated in the degradation position in FIG. 3C (0320). In the triggering position (0330), the firing pin (0304) in the energetic device is triggered as the restraining element (0303) no longer holds or restrains the firing pin (0304) due to change of shape or strength. The entire stored energy may be applied to move the firing pin and contact a bidirectional booster, after the pre-determined time delay in the degradation position. The stored energy may be applied by pressure and seal, magnetic field, a weight, a spring or combination thereof.

Figure 4A:
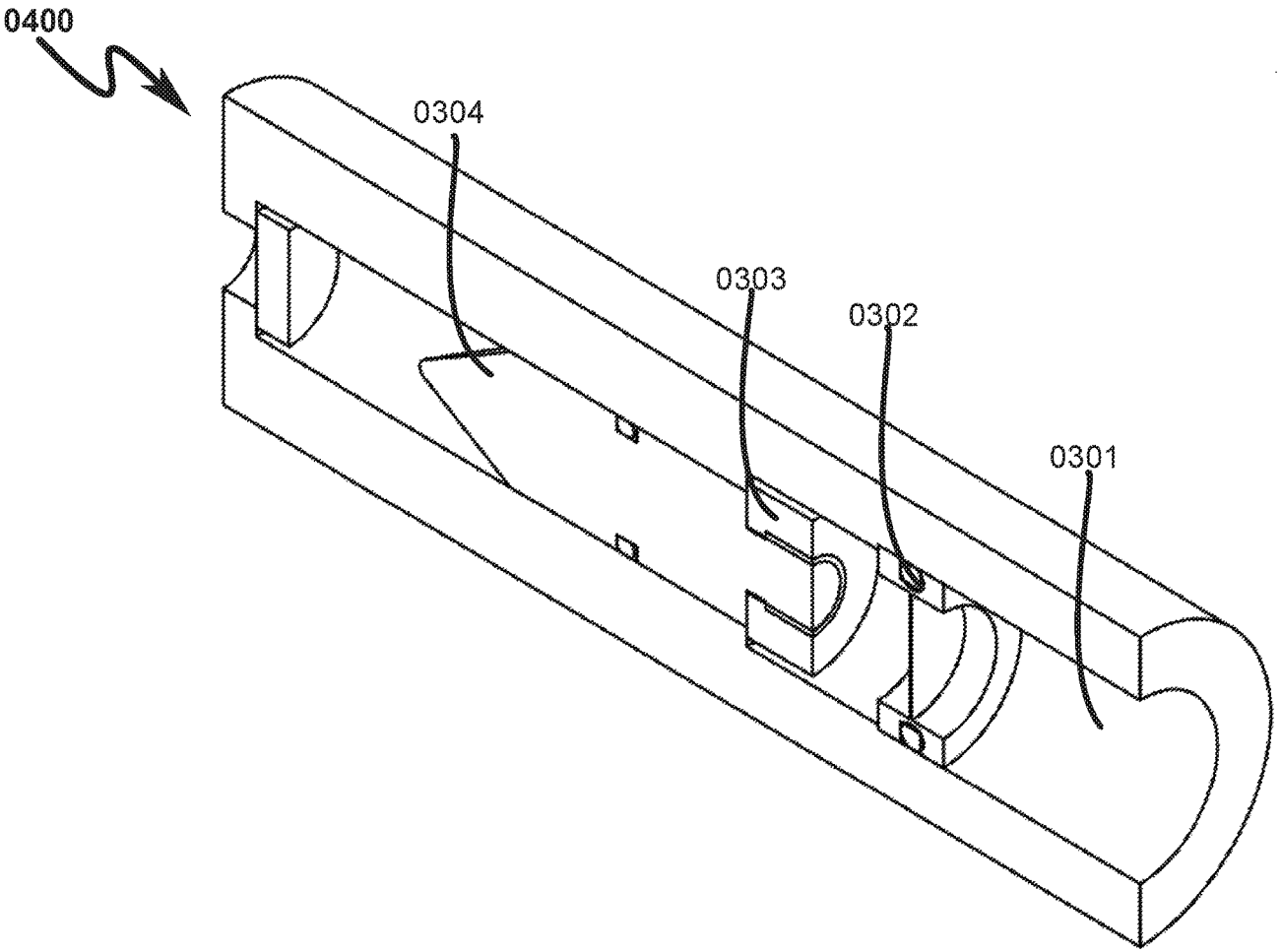
FIG. 4A illustrates a perspective view of a downhole wellbore time delay tool with an energetic device and a firing pin according to an exemplary embodiment of the present invention.

FIG. 4A (0400) generally illustrates a perspective view of the downhole delay tool with a firing pin as the wellbore device.

Figure 3E:
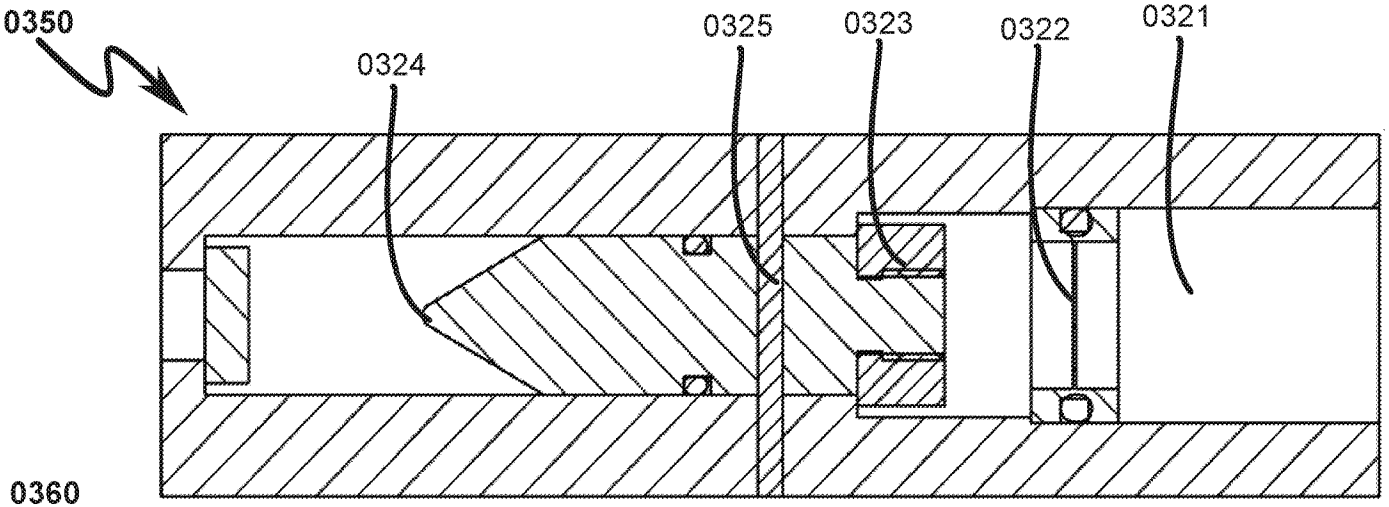
FIGS. 3E-3H illustrates a cross-section view of downhole wellbore time delay tool with an energetic device and a firing pin with a shear pin restraint describing an initial set up, actuation position, a degradation position, and a triggering position according to an exemplary embodiment of the present invention.
Figure 3F:
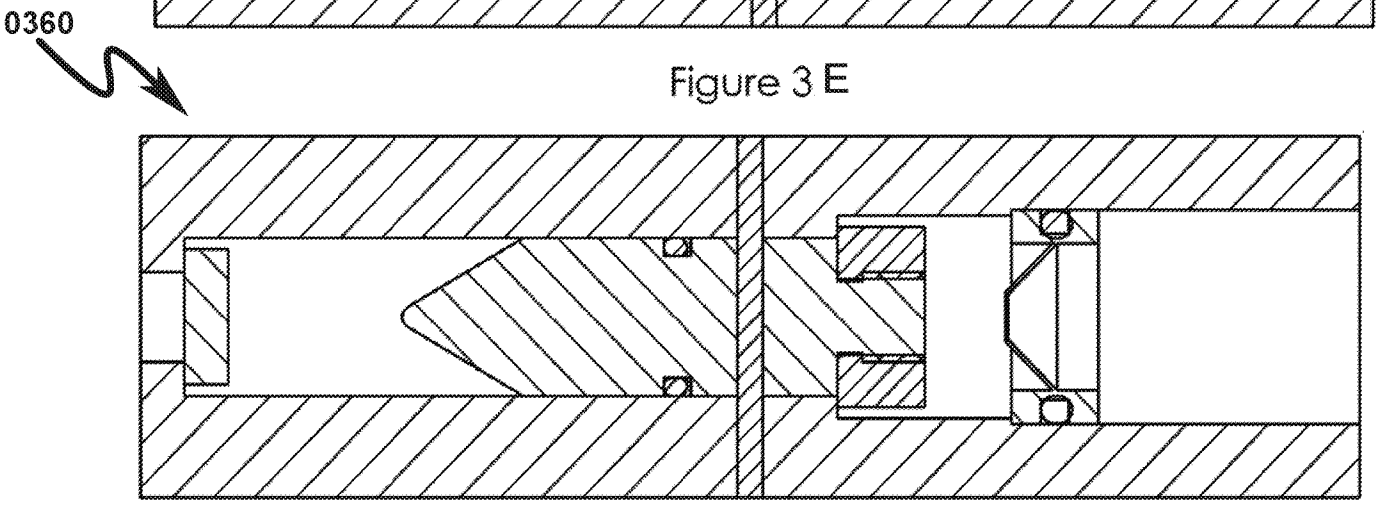
Figure 3G:
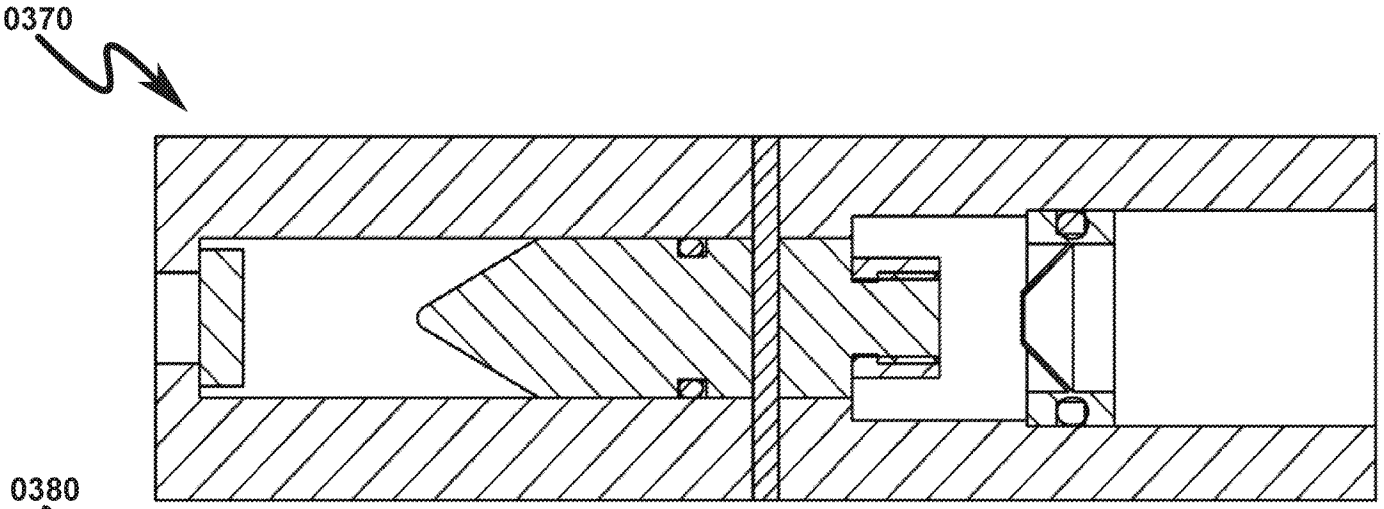
Figure 3H:
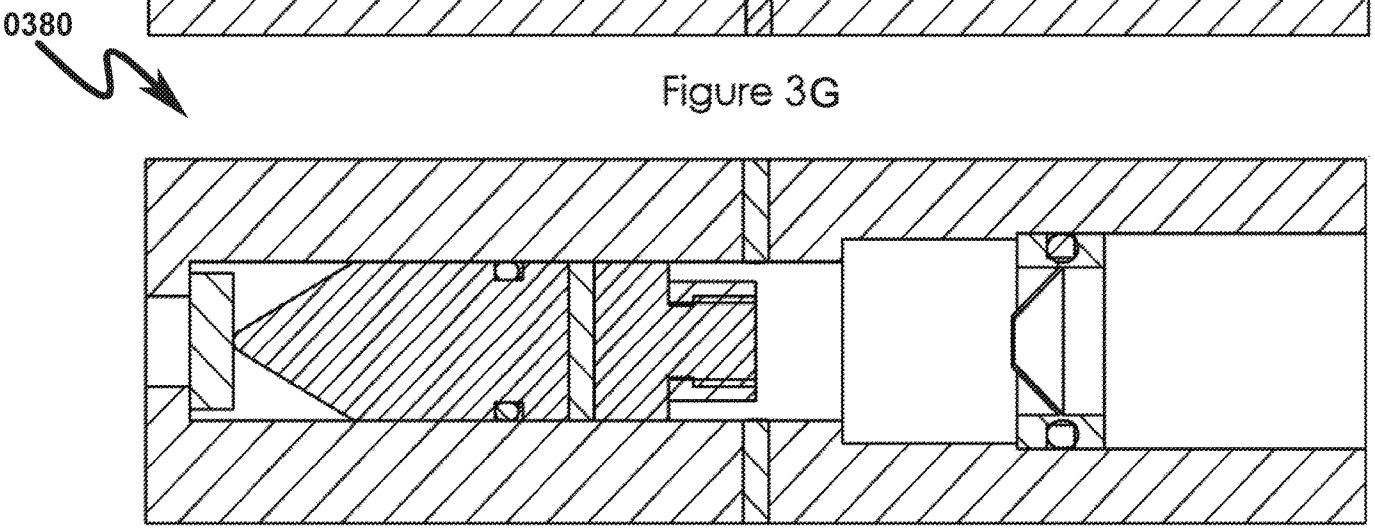
Figure 4B:
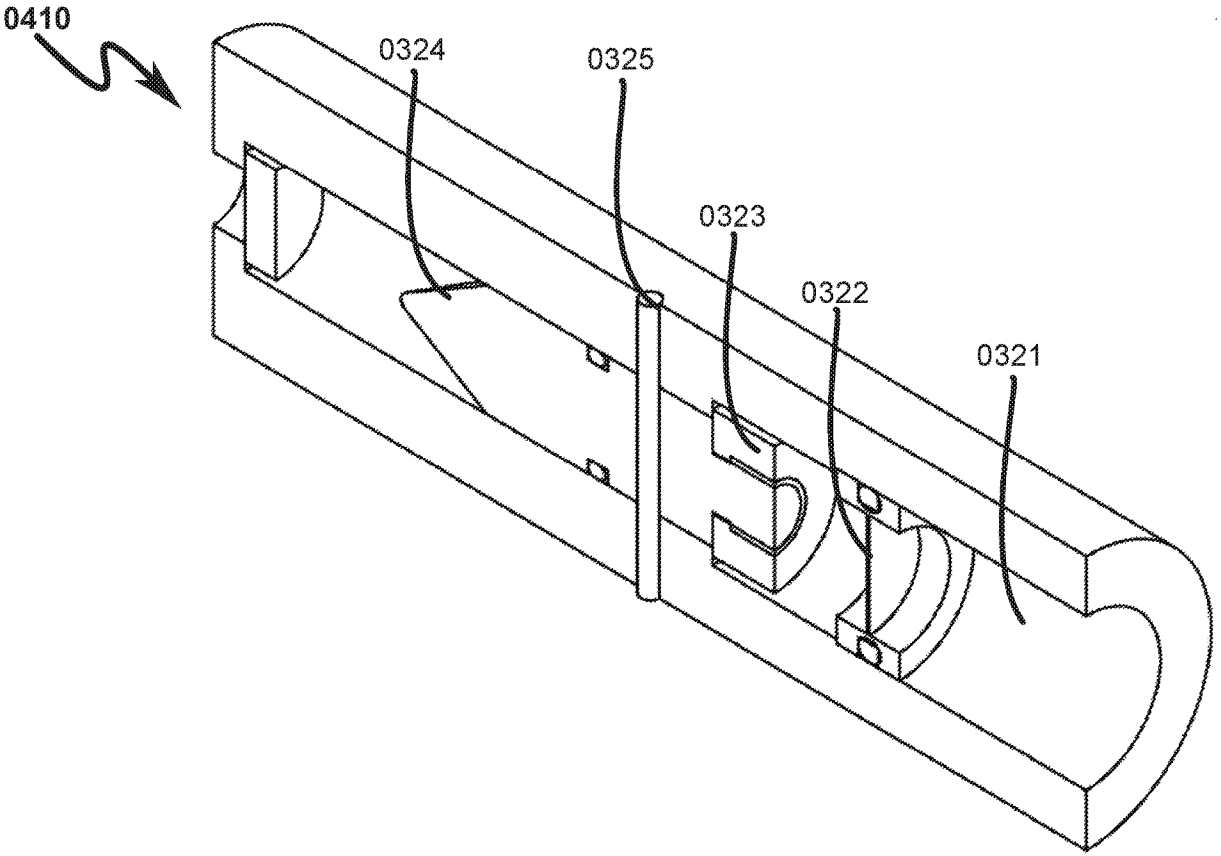
FIG. 4B illustrates a perspective view of a downhole wellbore time delay tool with an energetic device and a firing pin with a shear pin restraint according to an exemplary embodiment of the present invention.

Similar to FIGS. 3A-3D, a downhole delay tool with a firing pin and a shear pin restraint is generally illustrated in FIGS. 3E-3H. As generally illustrated in more detail in FIG. 3E (0350), FIG. 3F (0360), FIG. 3G (0370), FIG. 3H (0380), wherein the downhole wellbore delay tool is deployed inside a wellbore casing. FIGS. 3E-3H generally illustrates different positions of a firing pin assembly (0324) restrained by a shear pin (0325) in addition to a mechanical restraining element (0323). The positions include an initial set up position (0350), an actuation position (0360), a degradation position (0370) and a triggering position (0380). A detailed view of the tool in the initial set up position is shown in FIG. 3E (0350) wherein the fluid in the reservoir is held by the actuating device (0322). When ready to operate, the pressure is increased for example with TCP. The tool then moves to the actuation position (0360), when pressure acting on the actuating device (0322) exceeds its rated pressure, the actuation device ruptures and enables reactive fluid in the fluid reservoir (0321) or well fluids from the wellbore casing to enter the adjacent chamber and contacts the restraining element. Subsequently, after elapse of a pre-determined time delay, the restraining element degrades or changes shape due to the chemical reaction as illustrated in the degradation position in FIG. 3G (0370). In the triggering position (0380), the firing pin (0324) in the energetic device is triggered as the restraining element (0323) no longer holds or restrains the firing pin (0324) and the shear pin (0325) due to change of shape or a physical property. According to a preferred exemplary embodiment, the shear pins provide additional control, when the time delay enables, but it would need an active input to finally fire. FIG. 4B (0410) generally illustrates a perspective view of the downhole delay tool with an energetic device and a firing pin and a shear pin restraint mechanism as the wellbore device. The mechanical restraining element (0323) could be degraded, releasing the shear pin (0325), and then the tool would have to be pumped to a pressure sufficient to shear the shear pins (0325), which would allow the firing pin (0324) to strike a percussion initiator (not shown).

Figure 5A:
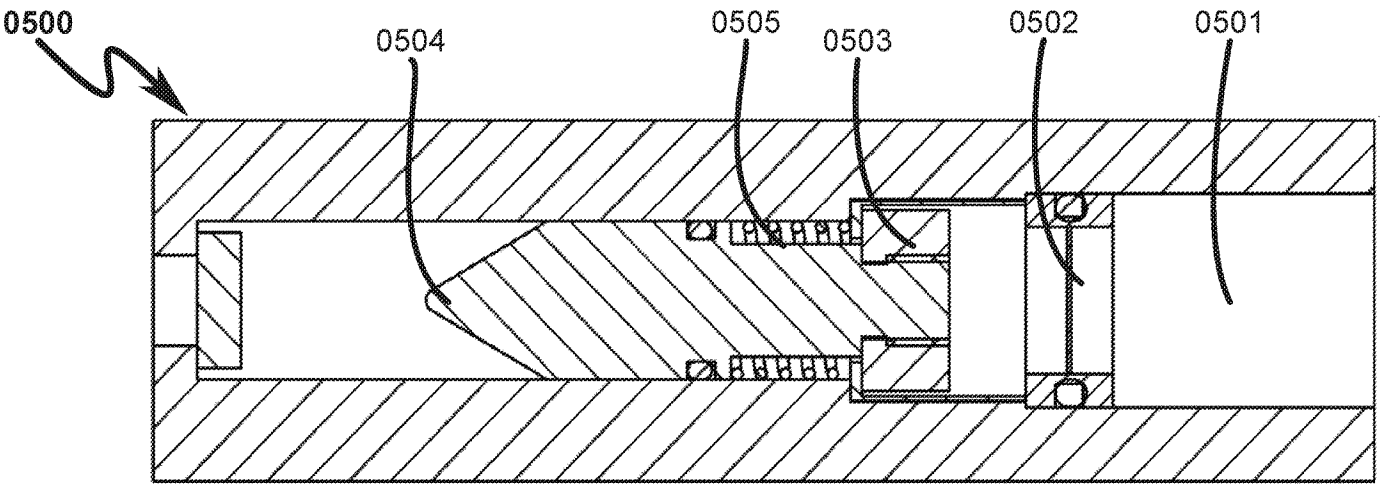
FIGS. 5A-5D illustrates a cross-section view of downhole wellbore time delay tool with an energetic device and a firing pin and a spring loaded device describing an initial set up, actuation position, a degradation position, and a triggering positions according to an exemplary embodiment of the present invention.
Figure 5B:
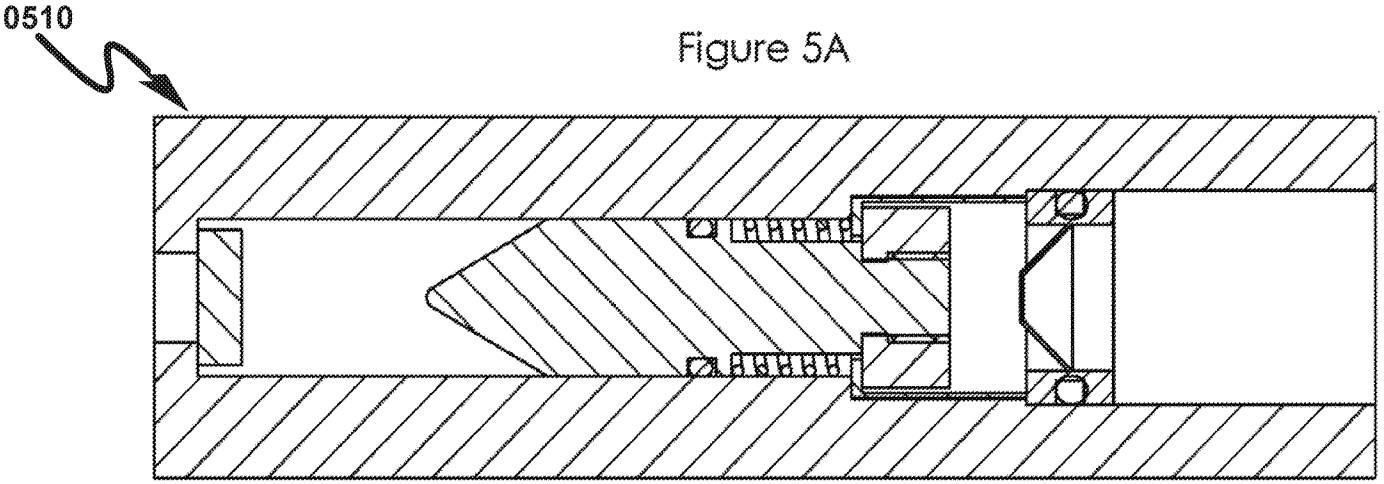
Figure 5C:
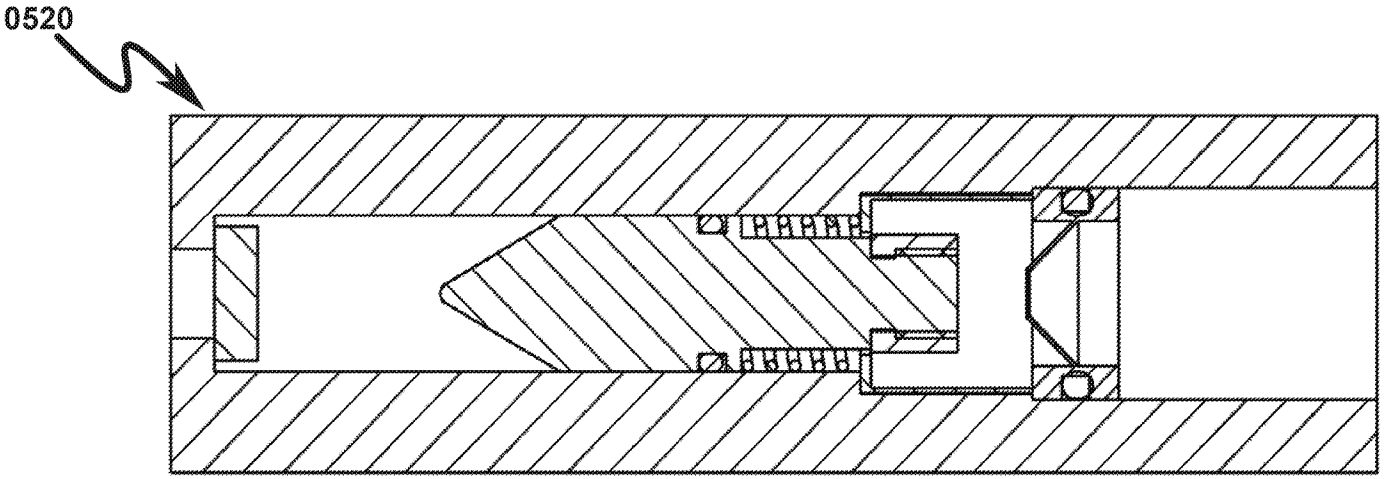
Figure 5D:
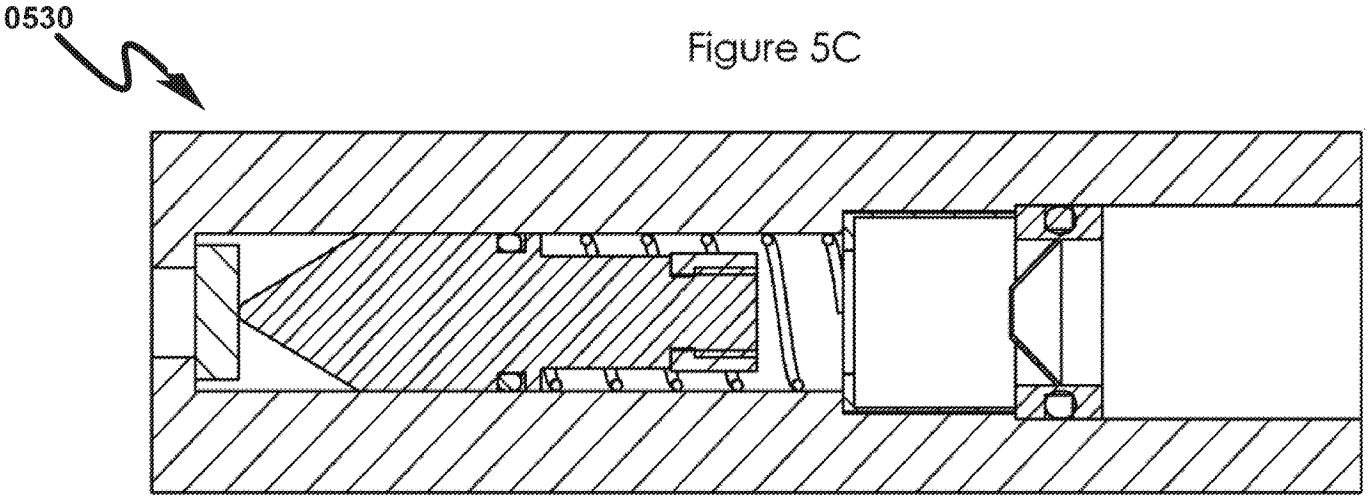
Figure 6:
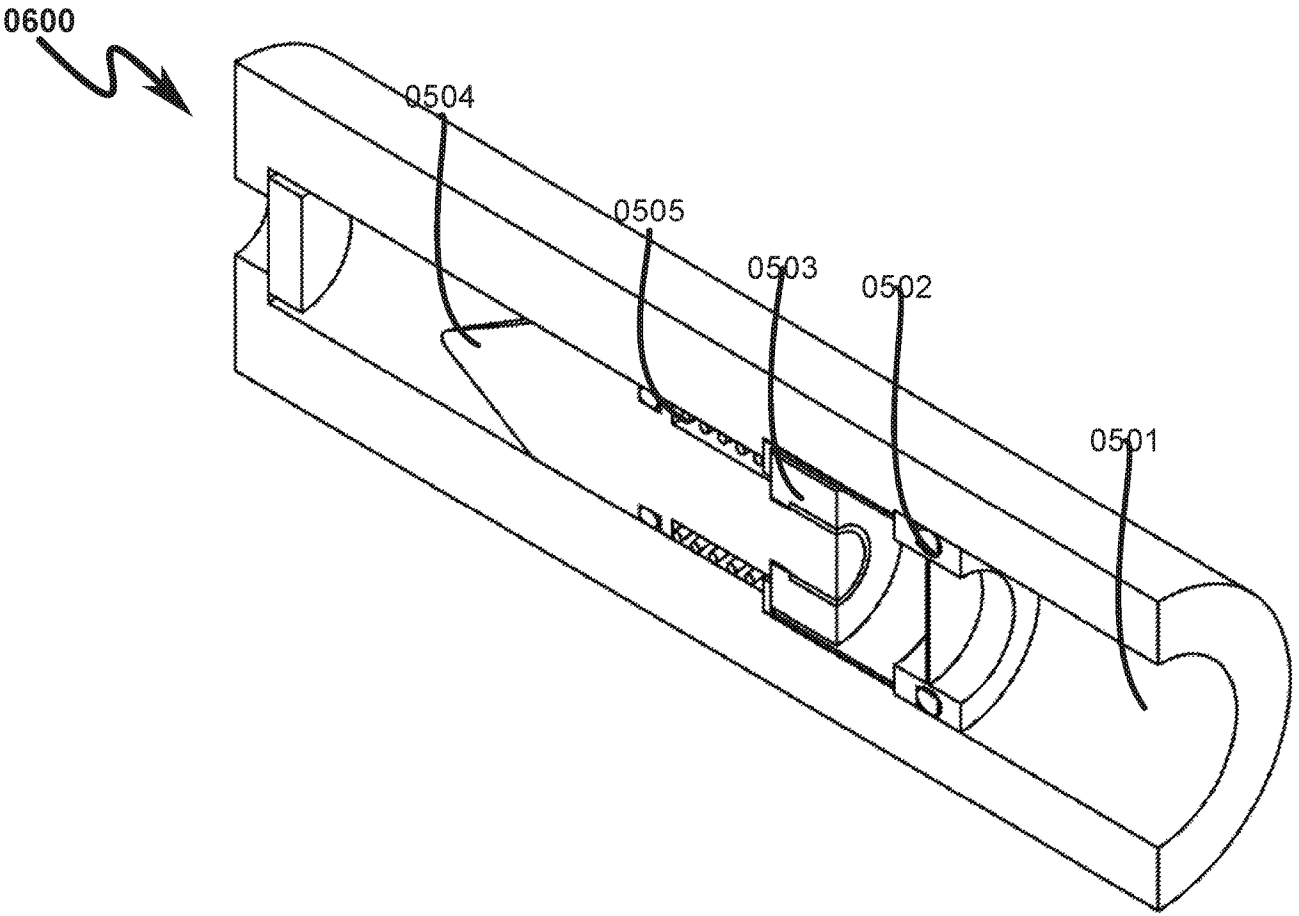
FIG. 6 illustrates a perspective view of a downhole wellbore time delay tool with an energetic device and a firing pin and a spring loaded device according to an exemplary embodiment of the present invention.

Similar to FIGS. 3A-3D, a downhole delay tool with a firing pin and a spring is generally illustrated in FIGS. 5A-5D. As generally illustrated in more detail in FIG. 5A (0500), FIG. 5B (0510), FIG. 5C (0520), FIG. 5D (0530), wherein the downhole wellbore delay tool is deployed inside a wellbore casing. FIGS. 5A-5D generally illustrates different positions of a firing pin assembly (0504) restrained by a spring (0505). The positions include an initial set up position (0500), an actuation position (0510), a degradation position (0520) and a triggering position (0530). A detailed view of the tool in the initial set up position is shown in FIG. 5A (0500) wherein the fluid in the reservoir is held by the actuating device (0502). When ready to operate, the pressure is increased for example with TCP. The tool then moves to the actuation position (0510), when pressure acting on the actuating device (0502) exceeds its rated pressure, the actuation device ruptures and enables reactive fluid in the fluid reservoir (0501) to enter the adjacent chamber and contacts the restraining element. Subsequently, after elapse of a pre-determined time delay, the restraining element degrades or changes shape due to the chemical reaction as illustrated in the degradation position in FIG. 5C (0520). In the triggering position (0530), the firing pin (0504) in the energetic device is triggered as the restraining element (0503) no longer holds or restrains the firing pin (0504) and the spring (0505) due to change of shape or a physical property. FIG. 6 (0600) generally illustrates a perspective view of the downhole delay tool with an energetic device and a firing pin and a spring loading mechanism as the wellbore device.

Preferred Exemplary Downhole Wellbore Time Delay Tool Integrated with a Spool Valve (0700-0800)

Figure 7A:
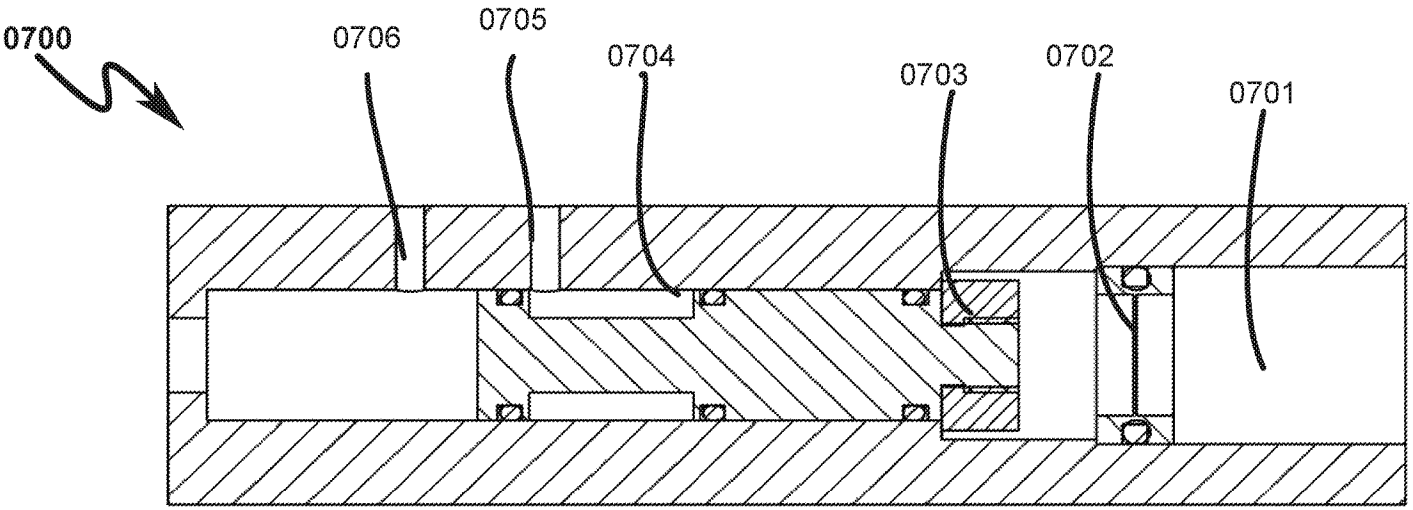
FIGS. 7A-7D illustrates a cross-section view of downhole wellbore time delay tool with a spool valve describing an initial set up, actuation position, a degradation position, and a triggering positions according to an exemplary embodiment of the present invention.
Figure 7B:
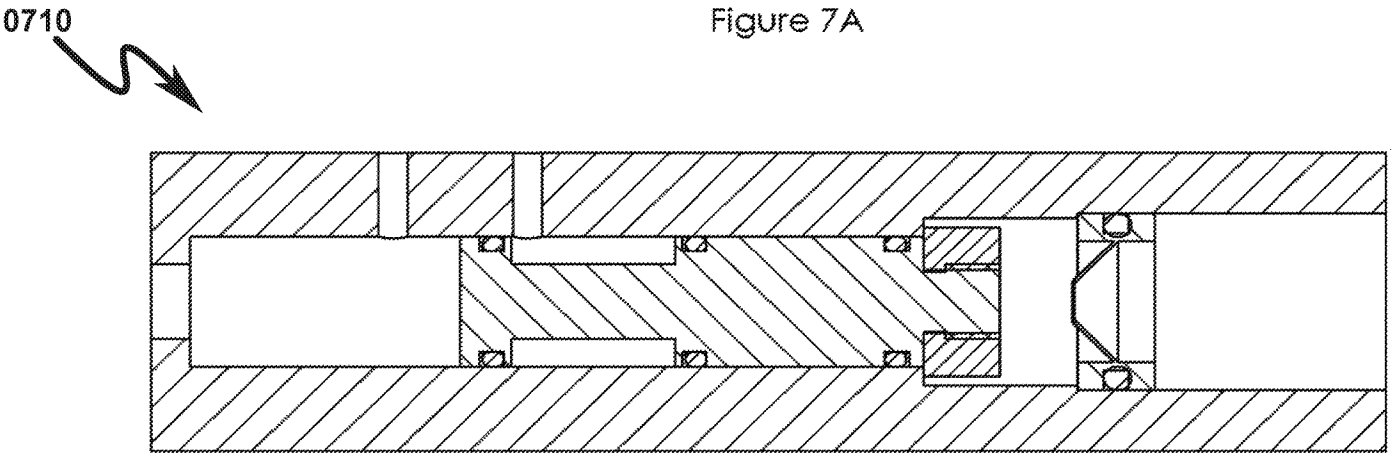
Figure 7C:
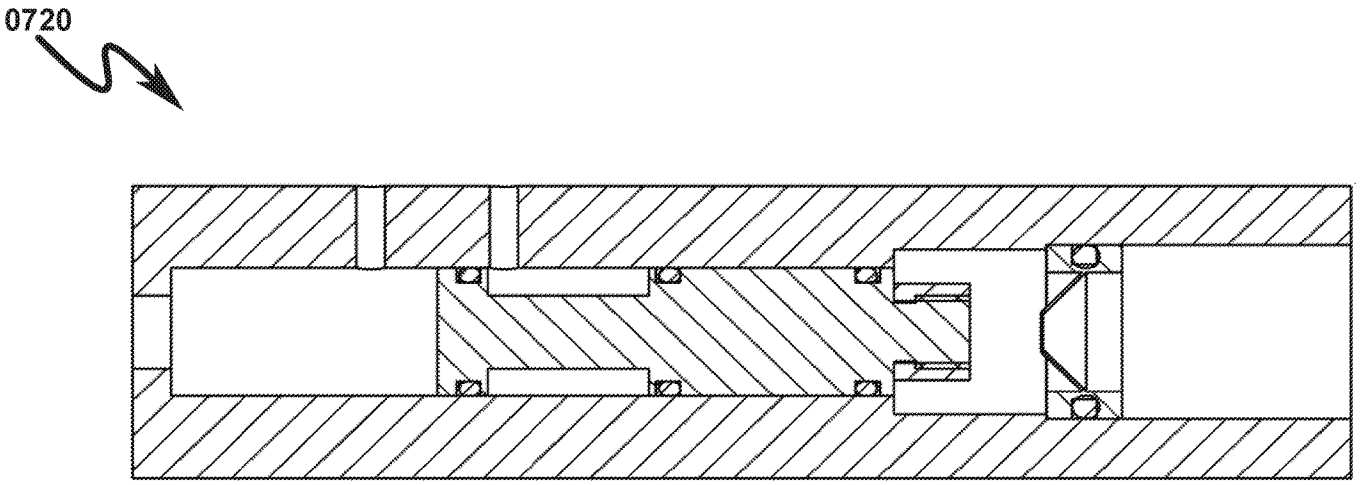
Figure 7D:
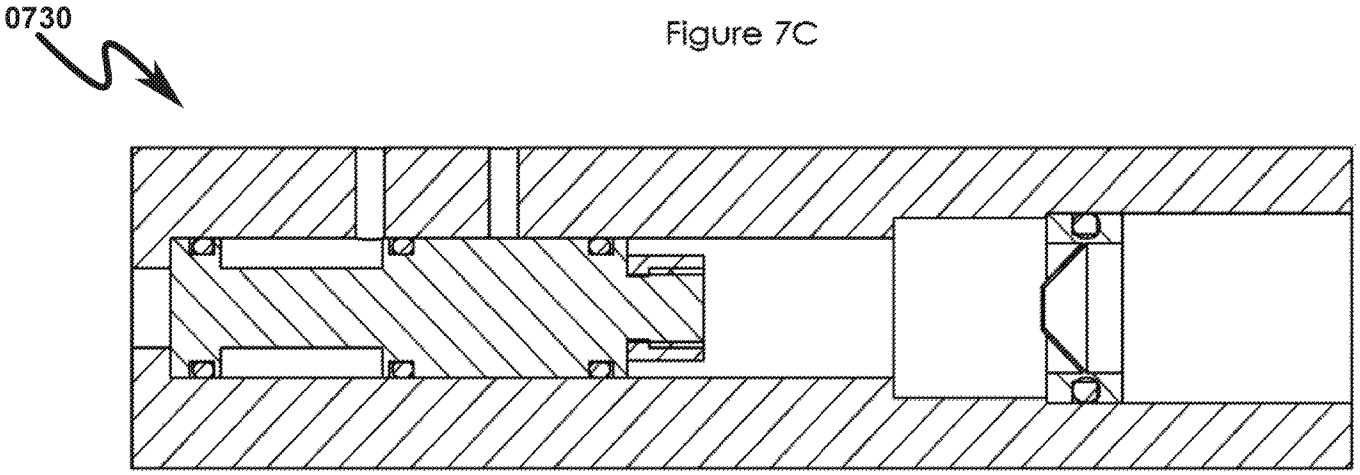
Figure 7E:
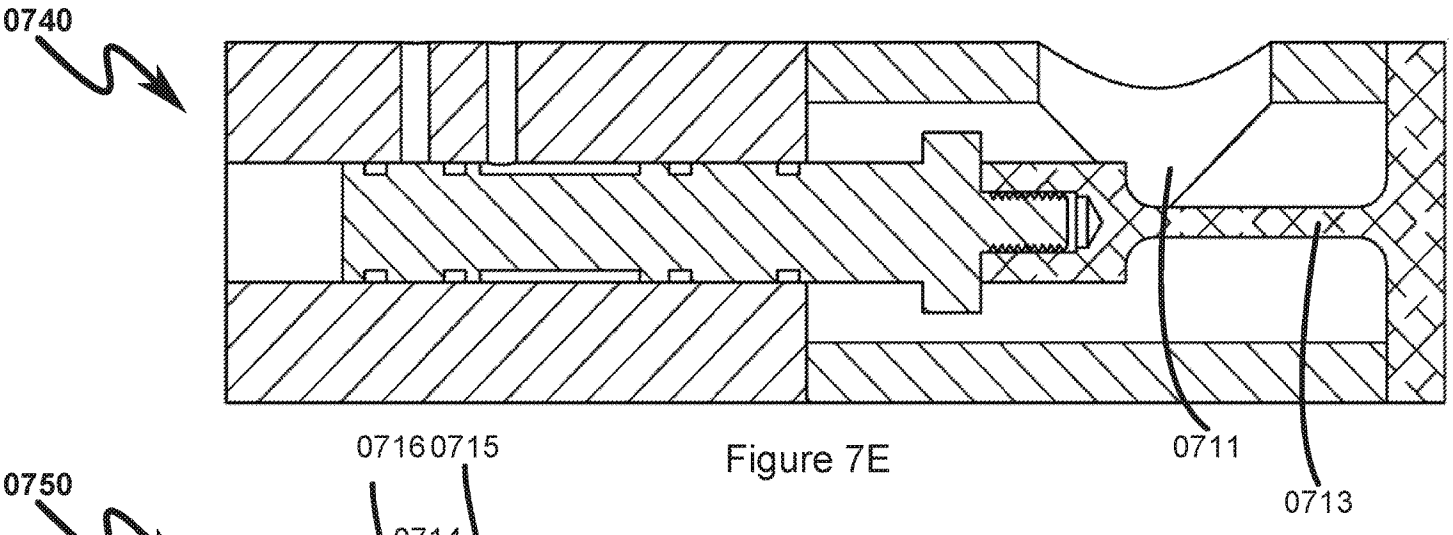
FIGS. 7E-7F illustrates a cross-section view of downhole wellbore time delay tool with a spool valve and a tensile member according to an exemplary embodiment of the present invention.
Figure 7F:
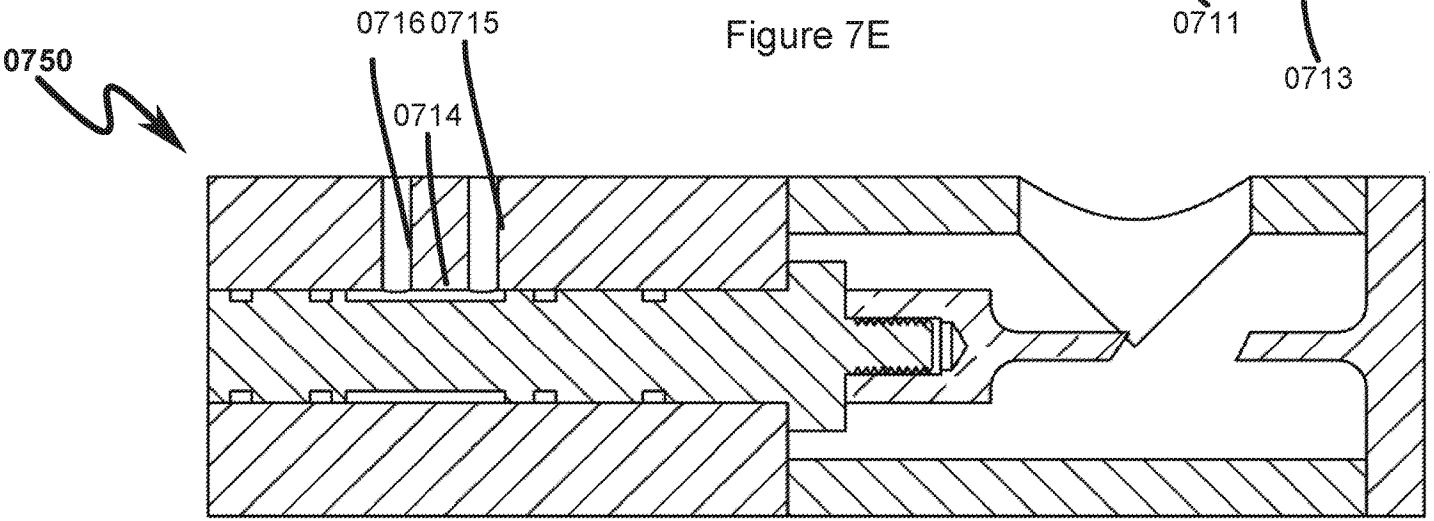
Figure 8:
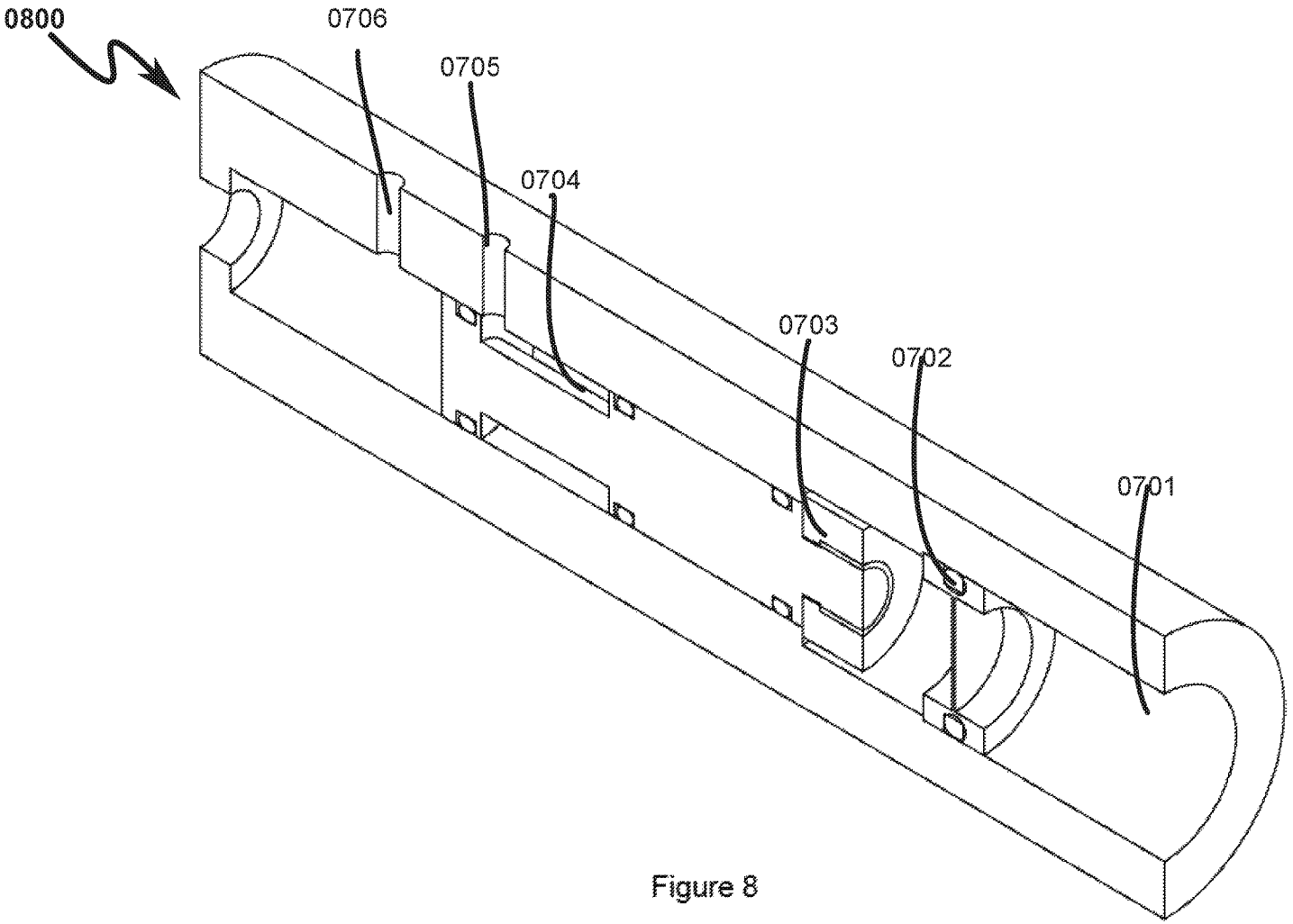
FIG. 8 illustrates a perspective view of a downhole wellbore time delay tool with a spool valve according to an exemplary embodiment of the present invention.

Similar to FIGS. 3A-3D, a downhole delay tool with a spool valve is generally illustrated in FIGS. 7A-7D. A detailed view of the tool in the initial set up position is shown in FIG. 7A (0700) wherein the fluid in the reservoir is held by the actuating device (0702) and a sleeve (0704) may block ports (0705, 0706) and disable pressure or fluid communication to a hydrocarbon formation. When ready to operate, the pressure is increased for example with TCP. The tool then moves to the actuation position (0710), when pressure acting on the actuating device (0702) exceeds its rated pressure, the actuation device ruptures and enables reactive fluid in the fluid reservoir (0701 to enter the adjacent chamber and contacts the restraining element (0703). Subsequently, after elapse of a pre-determined time delay, the restraining element degrades or changes shape due to the chemical reaction as illustrated in the degradation position in FIG. 7C (0720). In the triggering position (0730), a movement in a sleeve (0704) in the spool valve is triggered as the restraining element (0703) no longer holds or restrains the sleeve (0704) due to change of shape. After being released from the restraining element, the sleeve (0704) may slide and unblock one or more ports (0705, 0706) and enable pressure or fluid communication to a hydrocarbon formation. Similar to the mechanical restraining element (0703) in FIG. 7A (0700), a tensile member (0713) is generally illustrated in FIG. 7E (0740). The tensile member (0713)

may react with a reactive fluid from a reservoir (0711) and provide a time delay for the tensile member (0713) to break and enable a sleeve in the spool valve to slide and open ports (0714, 0715). FIG. 7F (0750) generally illustrates a sleeve position after the ports (0714, 0715) are opened to the hydrocarbon formation. FIG. 8 (0800) generally illustrates a perspective view of the downhole delay tool with a spool valve and a sliding sleeve as a wellbore device.

Preferred Exemplary Downhole Wellbore Time Delay Tool Integrated with a Pin and a Switch (0900-1000)

Figure 9A:
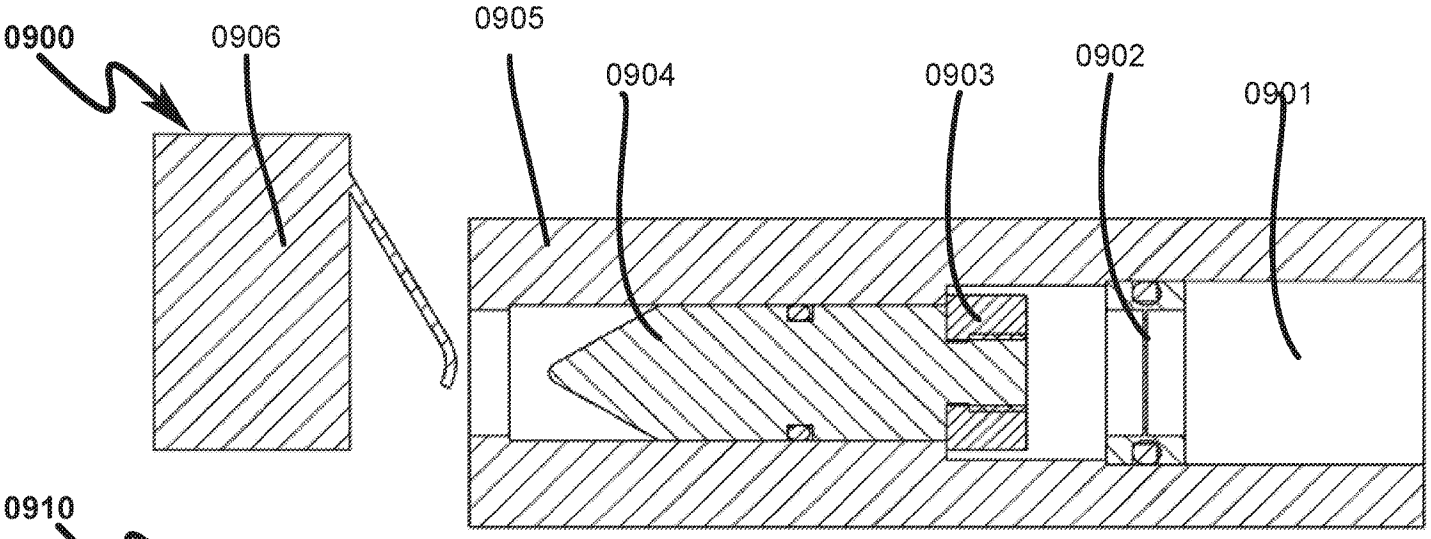
FIGS. 9A-9D illustrates a cross-section view of downhole wellbore time delay tool with a firing pin and a switch describing an initial set up, actuation position, a degradation position, and a triggering position according to an exemplary embodiment of the present invention.
Figure 9B:
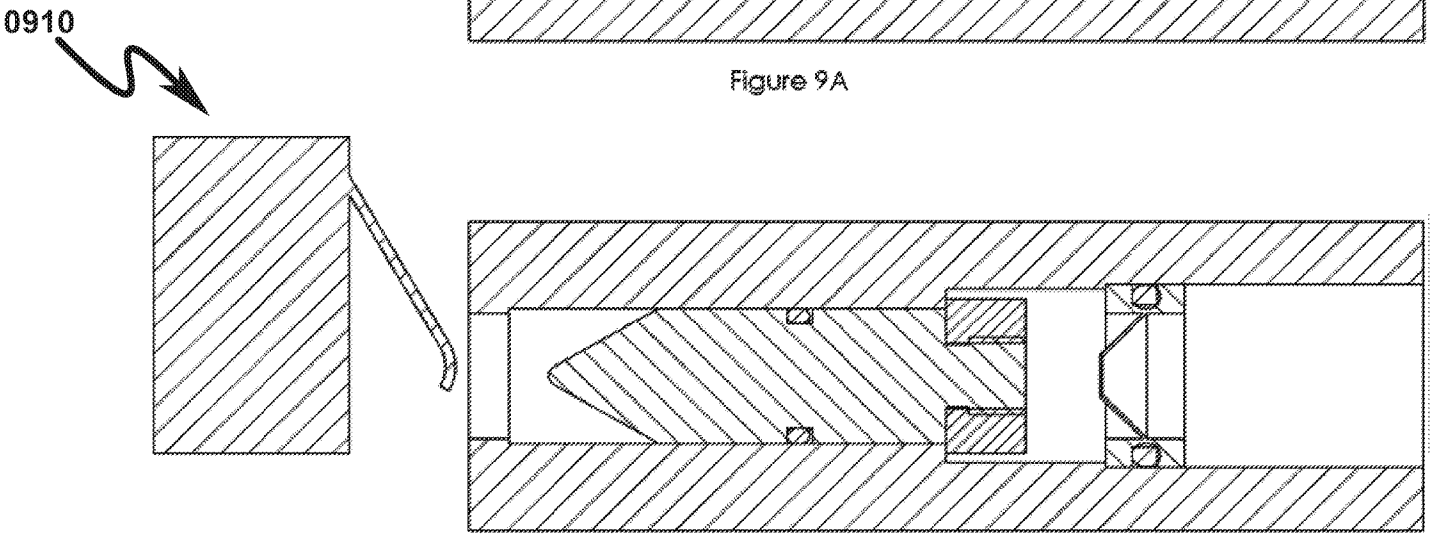
Figure 9C:
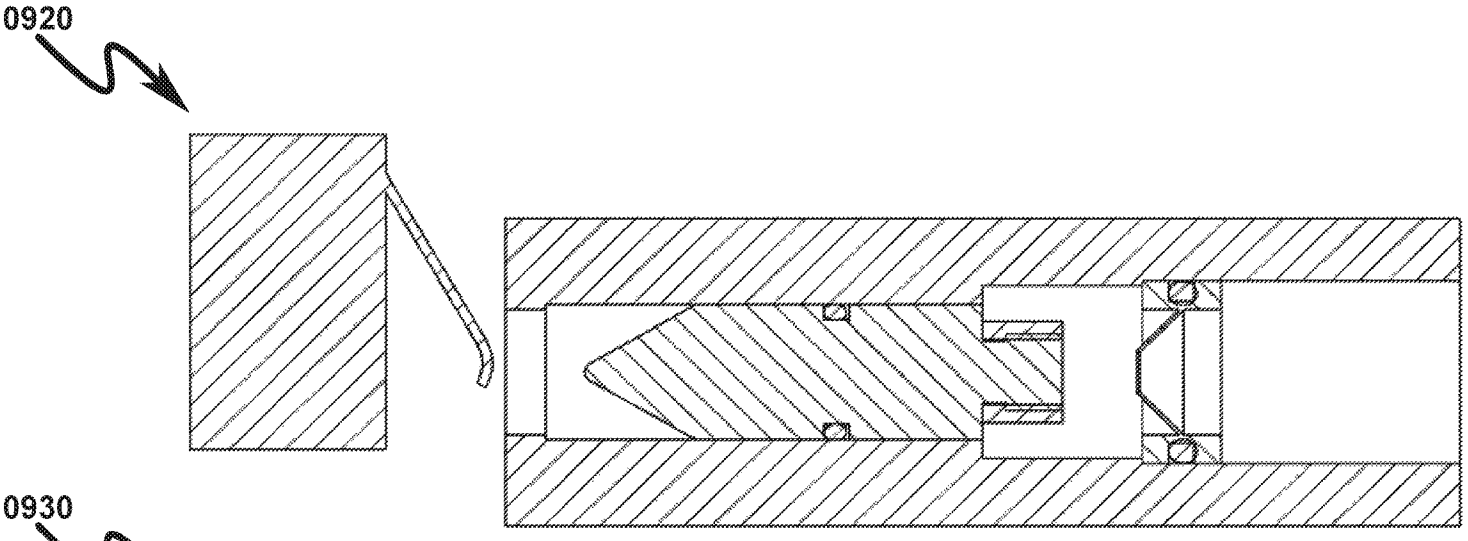
Figure 9D:
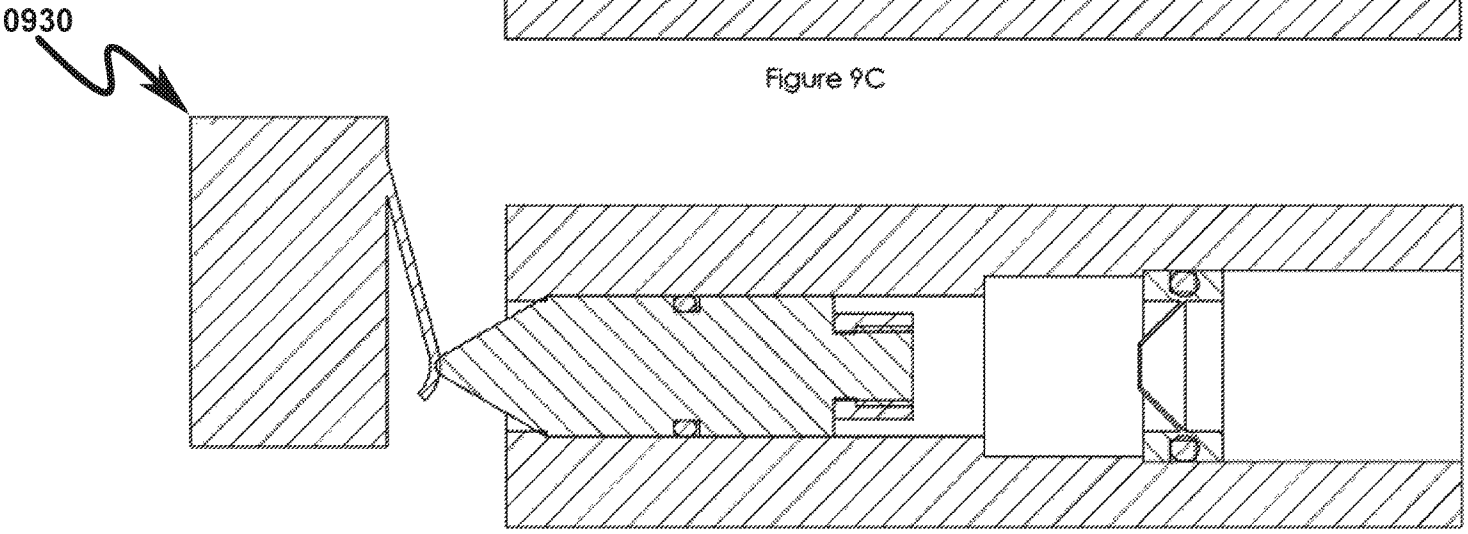
Figure 10:
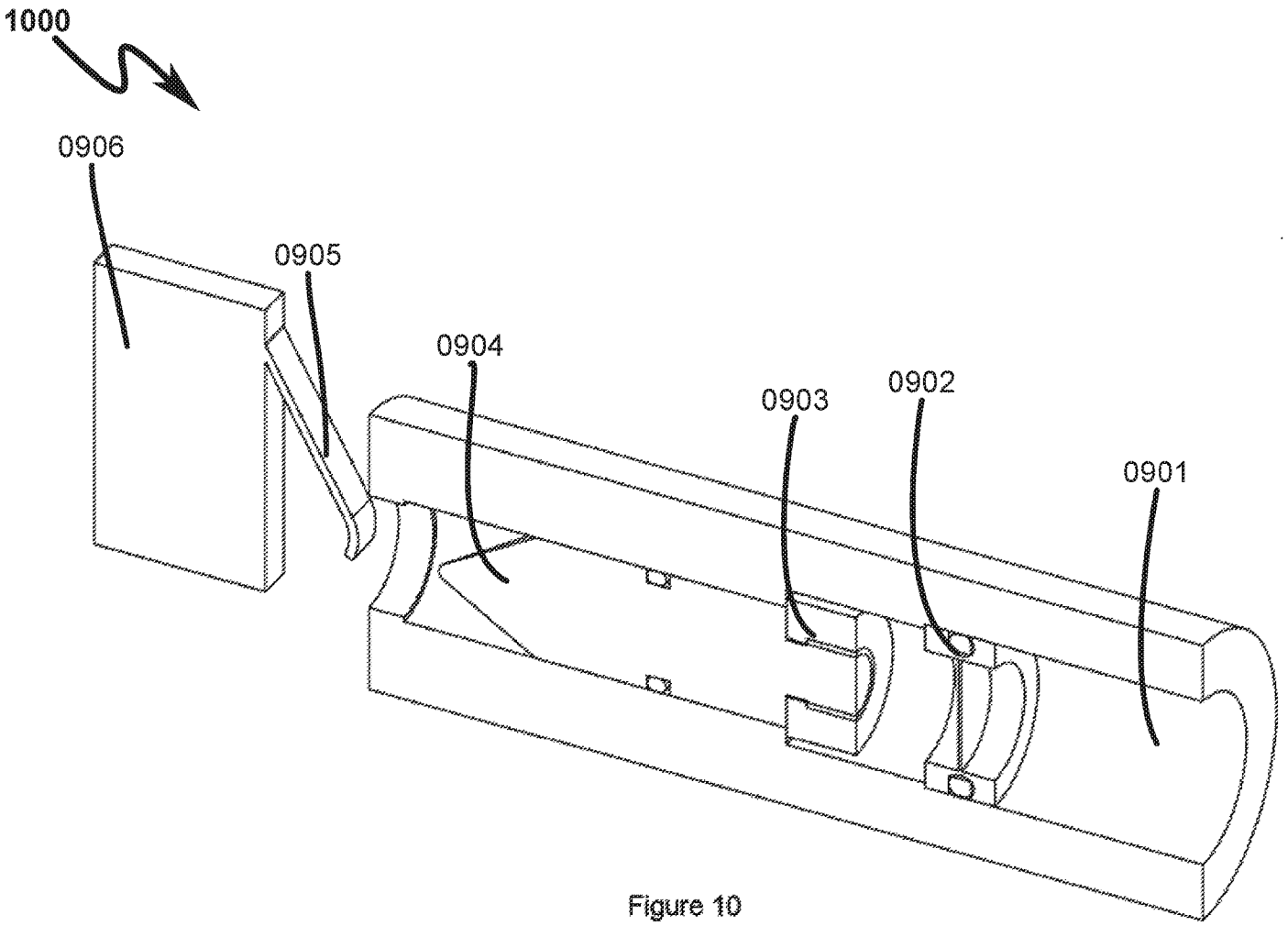
FIG. 10 illustrates a perspective view of a downhole wellbore time delay tool with a firing pin and a switch according to an exemplary embodiment of the present invention.

Similar to FIGS. 3A-3D, a downhole delay tool with a pin and a switch is generally illustrated in FIGS. 9A-9D. As generally illustrated in more detail in FIG. 9A (0900), FIG. 9B (0910), FIG. 9C (0920), FIG. 9D (0930), wherein the downhole wellbore delay tool is deployed inside a wellbore casing. FIGS. 9A-9D generally illustrate different positions of a firing pin assembly (0904) and a switch (0906) with a contact (0905). The positions include an initial set up position (0900), an actuation position (0910), a degradation position (0920) and a triggering position (0930). A detailed view of the tool in the initial set up position is shown in FIG. 9A (0900) where in the fluid in the reservoir is held by the actuating device (0902). In the initial set up position (0900), the electrical contact may not be connected to the pin (0904). When ready to operate, the pressure is increased for example with TCP. The tool then moves to the actuation position (0910), when pressure acting on the actuating device (0902) exceeds its rated pressure, the actuation device ruptures and enables reactive fluid in the fluid reservoir (0901) to enter the adjacent chamber and contacts the restraining element (0903). Subsequently, after elapse of a pre-determined time delay, the restraining element degrades or changes shape due to the chemical reaction as illustrated in the degradation position in FIG. 9C (0920). In the triggering position (0930), the pin (0904) in the wellbore device is triggered as the restraining element (0903) no longer holds or restrains the pin (0904) due to change of shape or a physical property. The movement of the pin enables the pin to complete an electrical connection that may be used to trigger an electrical event for purposes of perforating or determining a status. FIG. 10 (1000) generally illustrates a perspective view of the downhole delay tool with a pin and a switch as the wellbore device.

Preferred Exemplary Downhole Wellbore Time Delay Tool Integrated with a Degradable Restriction Element (1100)

Figure 11:
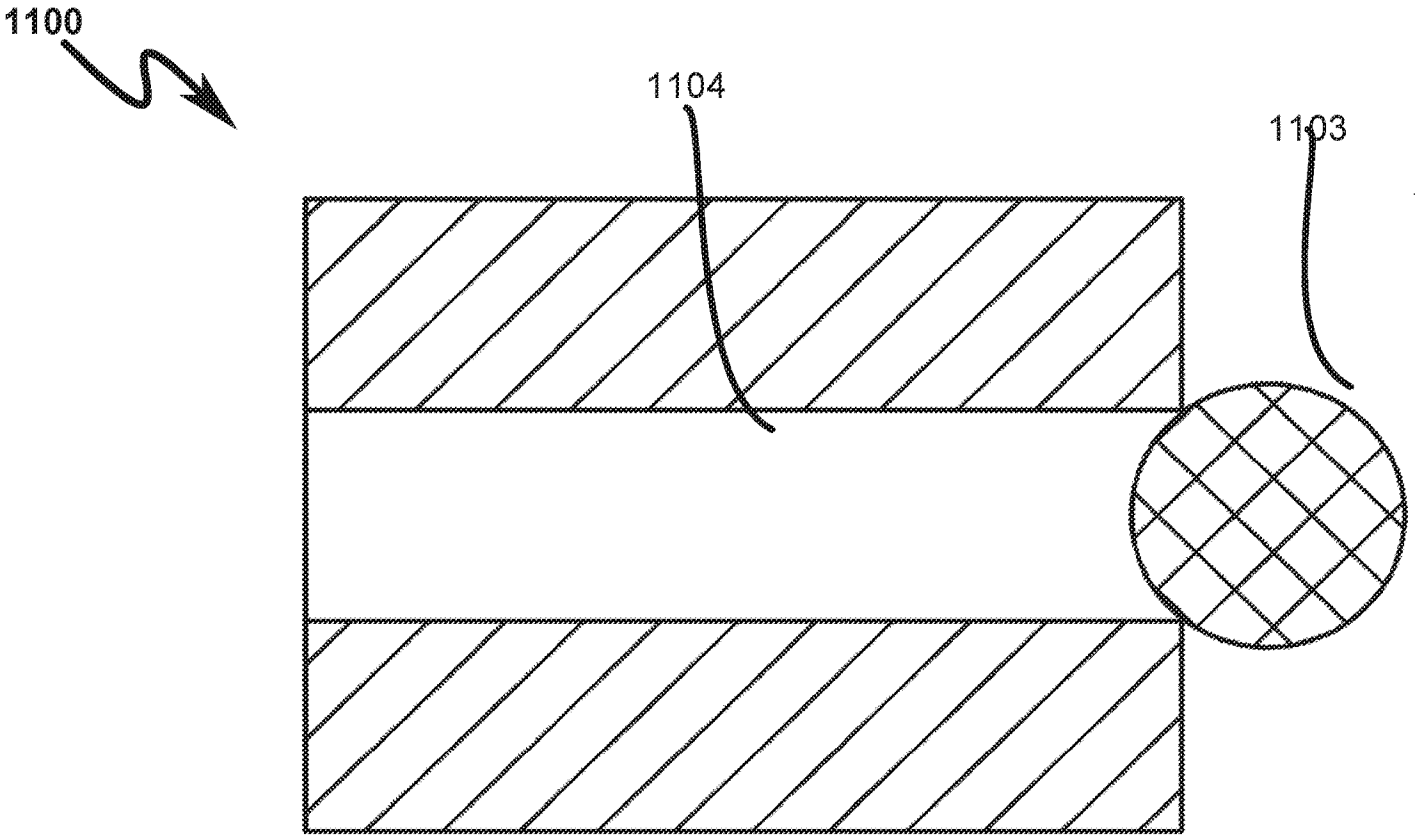
FIG. 11 illustrates a cross section view of a downhole wellbore time delay tool with a dissolvable plug according to an exemplary embodiment of the present invention

FIG. 11 (1100) generally illustrates a degradable restriction element (1103) blocking a flow channel (1104) in a wellbore casing. A known reactive fluid may be provided to react with the degradable restriction element (1103). After an elapse of a predictable time period, the degradable restriction element (1103) may degrade or change physical shape to enable fluid communication through the channel (1104).

Preferred Exemplary Flowchart Embodiment of a Time Delay Method (1200)

Figure 12:
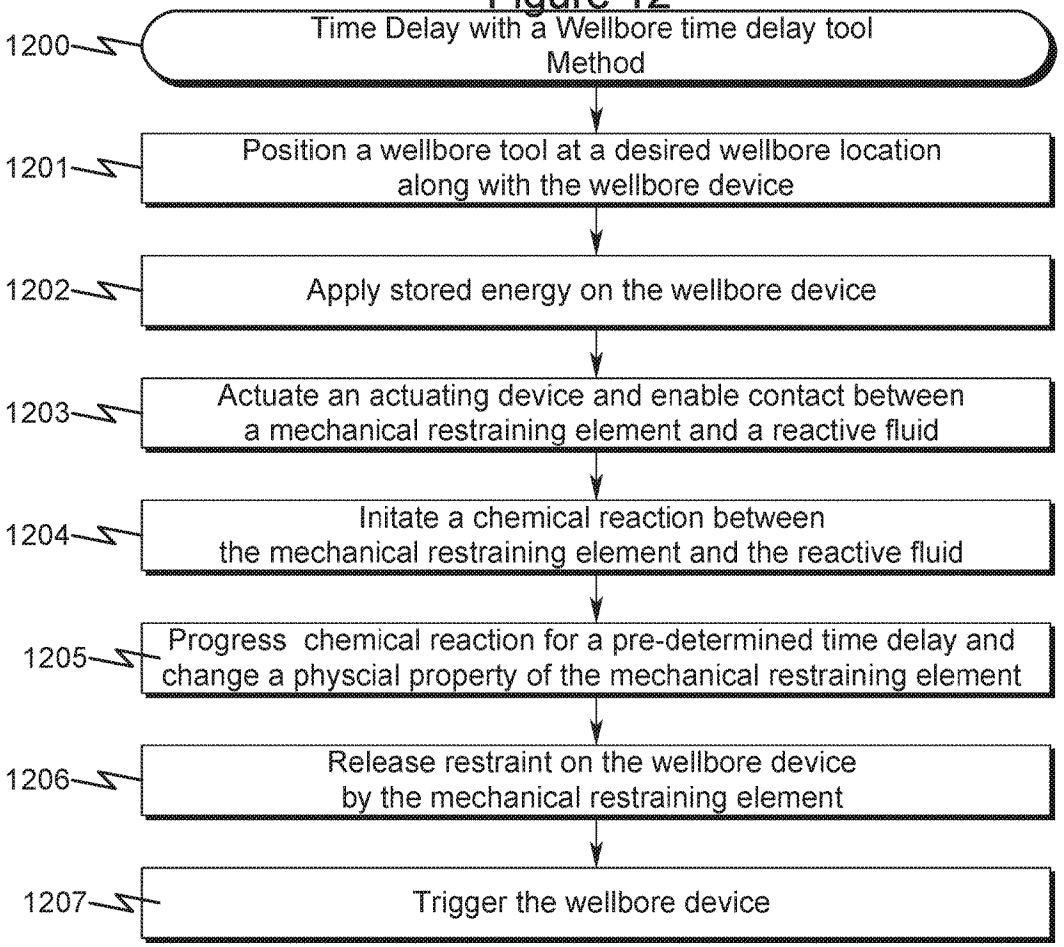
FIG. 12 illustrates an exemplary flow chart for a time delay method operating in conjunction with a downhole wellbore time delay tool according to an embodiment of the present invention.

As generally seen in the flow chart of FIG. 12 (1200), a preferred exemplary flowchart embodiment of a time delay method may be generally described in terms of the following steps:

(1) positioning a wellbore tool at a desired wellbore location (1201);

The entire tool may be piped into the casing string as an integral part of the string and positioned where functioning of the tool is desired or the tool may be deployed to the desired location using TCP, Coiled tubing (CT) or a wire line. The wellbore may be cemented or not. The wellbore tool and the wellbore device may be deployed separately or together.

(2) applying stored energy on the wellbore device (1202);

The stored energy may be applied by pressure and seal, magnetic field, a weight, a spring or combination thereof. The energy may be transferred via TCP or wireline. The stored energy may be directly applied via the restraining element. The stored energy may be applied indirectly via an actuating device and pressure.

(3) actuating the actuating device and enabling contact between the mechanical restraining element and the reactive fluid (1203);

If the differential pressure acting on the piston is greater than a rated pressure of a pressure activated opening device, the device ruptures and allows the piston to move. The rating of the pressure activated device could range from 5000 PSI to 15000 PSI.

(4) initiating a chemical reaction between the mechanical restraining element and the reactive fluid (1204);

According to a preferred exemplary embodiment the pre-determined time delay is determined by composition of the reactive fluids. According to another preferred exemplary embodiment the pre-determined time delay is determined by reaction rate of the reactive fluids with the mechanical restraining element. According to yet another preferred exemplary embodiment the pre-determined time delay is determined by reaction time of the reactive fluids with the mechanical restraining element. According to a further preferred exemplary embodiment the pre-determined time delay is determined by masking a contact area of the mechanical restraining element.

(5) progressing the chemical reaction for a pre-determined time delay and altering size of the mechanical restraining element (1205);

According to a preferred exemplary embodiment, the pre-determined time delay ranges from 1 hour to 48 hours. According to a more preferred exemplary embodiment, the pre-determined time delay ranges from 2 days to 14 days. According to a most preferred exemplary embodiment, the pre-determined time delay ranges from 0.01 seconds to 1 hour.

(6) releasing restraint on the wellbore device by the mechanical restraining element (1206); and the mechanical restraint may be a nut that decreases in size or loses threads and grip, thereby releasing the wellbore device.

(7) triggering the wellbore device (1207).

The triggering step (7) may move a piston in the wellbore device. The triggering step (7) may open a port in the wellbore device. The triggering step (7) may unplug a wellbore device. The triggering step (7) may enable a rotational movement in the wellbore device.

Preferred Exemplary Flowchart Embodiment of a Time Delay Firing Method (1300)

Figure 13:
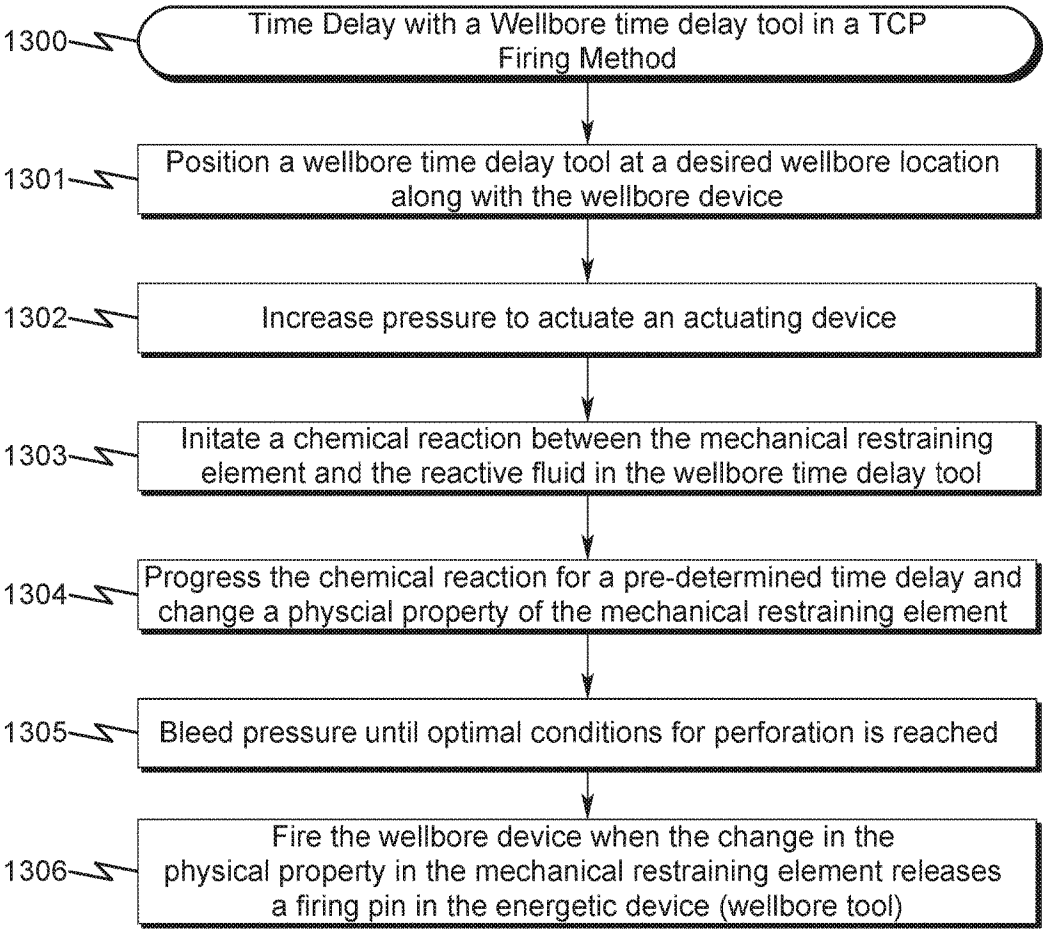
FIG. 13 illustrates a preferred exemplary flowchart embodiment of a time delay firing method in conjunction with a downhole wellbore time delay tool that is integrated into an energetic device used in TCP operation according to an embodiment of the present invention.

As generally seen in the flow chart of FIG. 13 (1300), a preferred exemplary flowchart embodiment of a time delay firing method in conjunction with a downhole wellbore time delay tool; the downhole wellbore time delay tool integrated into an energetic device used in TCP operation may be generally described in terms of the following steps:

(1) positioning a downhole wellbore time delay tool at a desired wellbore location (1301);

The entire tool may be piped into the casing string as an integral part of the string and positioned where functioning of the tool is desired or the tool may be deployed to the desired location using TCP or a wire line. The wellbore may be cemented or not. The downhole wellbore time delay tool may be a tool (0210) as aforementioned in FIG. 2 (0200).

(2) increasing pressure to actuate an actuating device (1302);

The pressure may be applied through TCP or the wellbore pressure may be pumped out until the actuating device such as a rupture disk ruptures.

(3) initiating a chemical reaction between a mechanical restraining element and a reactive fluid in the wellbore time delay tool (1303);

(4) progressing the chemical reaction for a pre-determined time delay and altering physical property of the mechanical restraining element (1304);

According to a preferred exemplary embodiment, the pre-determined time delay ranges from 1 hour to 48 hours. According to a more preferred exemplary embodiment, the pre-determined time delay ranges from 2 days to 14 days. According to a most preferred exemplary embodiment, the pre-determined time delay ranges from 0.01 seconds to 1 hour.

(5) bleeding pressure until optimal conditions for perforation is reached (1305); and bleeding pressure creates a balanced or an underbalanced condition for perforation.

(6) firing the wellbore device when the change in the physical property in the mechanical restraining element releases a firing pin in the energetic device (1306).

the mechanical restraining element may be a nut that decreases in size or loses threads and grip, thereby releasing the wellbore device. Alternatively, the mechanical restraining element may be a shear pin, a tensile member or a seal.

Preferred Exemplary Time vs Temperature Reaction Curve Embodiment (1400)

Figure 14:
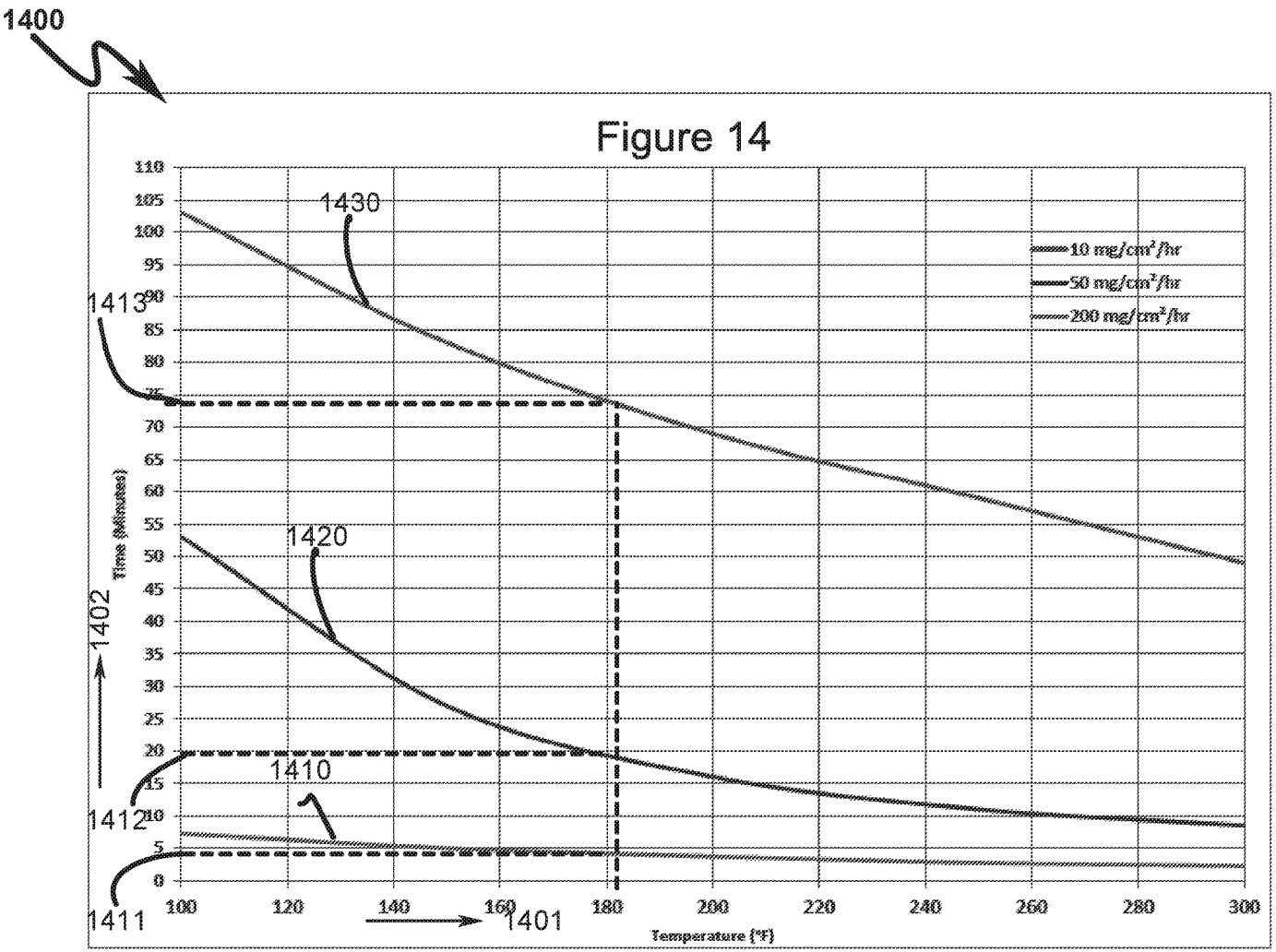
FIG. 14 illustrates an exemplary Time vs Temperature curve for calculating a time delay based on a known fluid and known restraining element according to an embodiment of the present invention.

A time (1401) vs temperature (1402) reaction curve is generally illustrated in FIG. 14 (1400). The nature of the curve depends on the known fluid type reacting with a material of a mechanical restraining element. For example, curve (1410) may represent a fluid type "A" reacting with a material "A" of a mechanical restraining element, curve (1420) may represent a fluid type B reacting with a material "B", and curve (1430) may represent a fluid type "C" reacting with a material "C". The reactive fluid may be a known fluid such as fresh water, salt water, KCL, NaCl, HCL, oil, hydrocarbon or combination thereof. The fluid may be contained in a reservoir (0211) as illustrated in FIG. 2. The mechanical restraining element may be a nut (0203) as illustrated in FIG. 2. The material of the mechanical restraining element may be a metal, a non-metal or an alloy. For example the material of the mechanical restraining element may be Aluminum, Magnesium or an aluminum-Magnesium alloy. A curve may be drawn for each combination of a known fluid and a known material. A model may be developed from the curve in order to calculate a time delay when a temperature is determined in a wellbore. For example, at a temperature of 180° F. the time delay for curve (1410) may be 4 minutes (1411). Similarly, the time delay for curve (1420) may be 20 minutes (1412) and time delay for curve (1430) may be 74 minutes (1413). A model may be developed for each combination of a known fluid and material. The model may be stored and used to determine a time delay when a temperature is determined in a wellbore casing. The predictability of time delay based on a measured temperature enables a triggering event to be delayed reliably with a greater accuracy. Any time delay may be achieved by changing the combination of the reactive fluid and material of the restraining element. The reservoir may be filled with the known fluid, wellbore fluids or a combination thereof. The mechanical restraining element may comprise one or more material types that react and have different degradation rates in one or more fluid types. The desired time delay may be achieved with a combination of fluid types and restraining element material types. The mechanical restraining element may be used in combination with a shear pin mechanism as illustrated in FIGS. 3E-3H so that additional control may be provided before a detonator can finally fire. According to a preferred exemplary embodiment, a predictable downhole time delay tool for determining time delay may comprise a known fluid and a known mechanical restraining element wherein the known fluid is configured to react with the mechanical restraining element; and the time delay is determined based upon a condition encountered in the wellbore when the known fluid reacts with the mechanical restraining element. According to another preferred exemplary embodiment, the time delay is further based on a pre-determined reaction curve between the known fluid and said the mechanical restraining element. According to yet another preferred exemplary embodiment, the wellbore condition is wellbore temperature. According to yet another preferred exemplary embodiment, the wellbore temperature is determined by distributed temperature sensing. The known fluid may be wellbore fluids that are sampled and characterized for time delay and temperature. The known fluid may be contained in a reservoir or an open chamber configured to permit fluid to interact with a restraining element.

Preferred Exemplary Flowchart Embodiment of a Time Delay Firing Method (1500)

Figure 15:
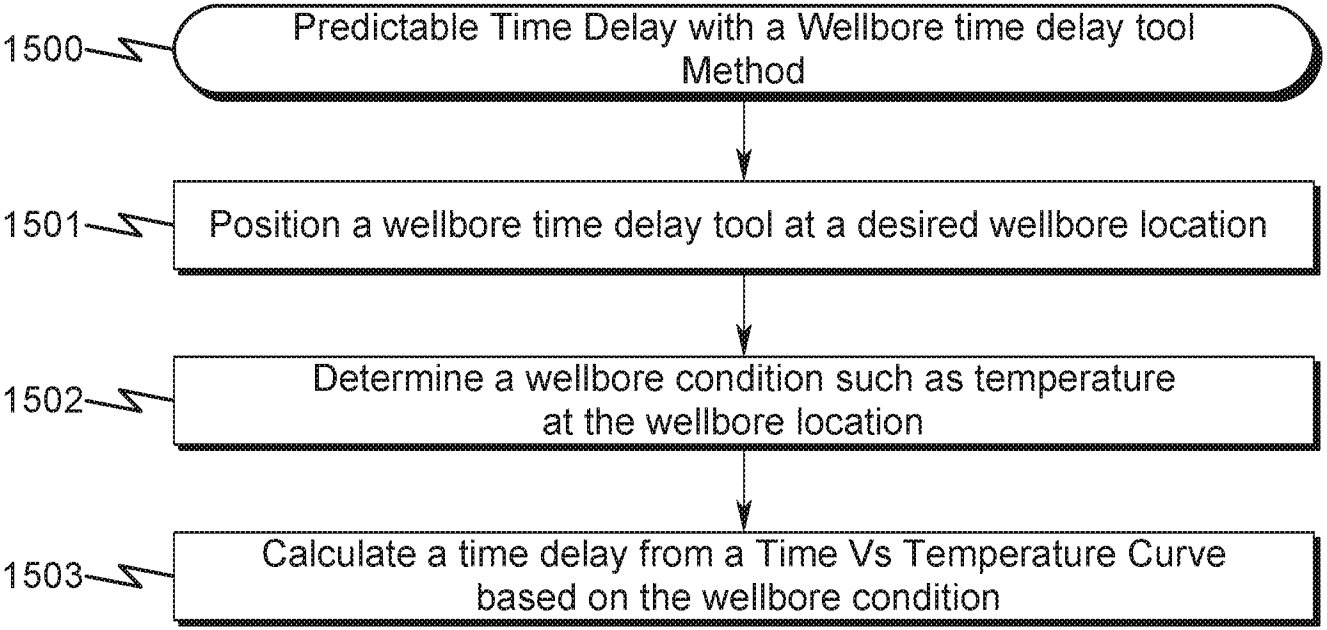
FIG. 15 illustrates an exemplary predictable time delay flowchart operating in conjunction with a predictable downhole time delay tool according to an embodiment of the present invention.

As generally seen in the flow chart of FIG. 15 (1500), a preferred exemplary flowchart embodiment of a predictable time delay method, the method operating in conjunction with a predictable downhole time delay tool comprising a known fluid and a known mechanical restraining element may be generally described in terms of the following steps:

(1) positioning the wellbore time delay tool at a desired wellbore location (1501);

The wellbore time delay tool may be deployed with TCP, CT, a slick line, a wire line or pumped from the surface.

(2) determining a wellbore condition at the wellbore location (1502); and

A wellbore condition such as a temperature may be determined with known methods. For example, a fiber optic cable run with the wellbore casing may be used to determine the temperature. Other wellbore conditions such as wellbore pressure, composition of the wellbore fluids may also be determined using know methods and tools.

(3) calculating a time delay based on the wellbore condition (1503).

A time delay may be calculated with a Time vs Temperature curve as illustrated in FIG. 14 (1400). A triggering event may be initiated in a wellbore device in the wellbore after elapse of said time delay. The triggering event may be the release of a firing pin to initiate a percussion primer to a detonation train. Another trigger event may be unplugging a restriction in a wellbore casing. Yet another triggering event may be sliding a piston to open a port to establish a connection to a hydrocarbon formation.

System Summary

The present invention system anticipates a wide variety of variations in the basic theme of time delay, but can be generalized as a downhole wellbore time delay tool for use with a wellbore device in a wellbore casing, comprising:

(a) a mechanical restraining element;

(b) a reactive fluid, said reactive fluid configured to react with the mechanical restraining element;

(c) an actuating device configured to enable fluid communication between the reactive fluid and the mechanical restraining element;

whereby, when a stored energy is applied on the wellbore device, the actuating device actuates and the reactive fluid comes in contact with the mechanical restraining element and initiates a chemical reaction; the chemical reaction enables a physical property change in the mechanical restraining element such that the stored energy applied on the wellbore device is delayed by a pre-determined time delay while the mechanical restraining element undergoes the physical property change.

This general system summary may be augmented by the various elements described herein to produce a wide variety of invention embodiments consistent with this overall design description.

Method Summary

The present invention method anticipates a wide variety of variations in the basic theme of implementation, but can be generalized as a downhole wellbore time delay tool for use with a wellbore device in a wellbore casing, comprising:

(a) a mechanical restraining element;

(b) a reactive fluid, said reactive fluid configured to react with the mechanical restraining element;

(c) an actuating device configured to enable fluid communication between the reactive fluid and the mechanical restraining element;

wherein the method comprises the steps of:

(1) positioning the wellbore tool at desired wellbore location;

(2) applying stored energy on the wellbore device;

(3) actuating the actuating device and enabling fluid communication between the mechanical restraining element and the reactive fluid;

(4) initiating a chemical reaction between the mechanical restraining element and the reactive fluid;

(5) progressing the chemical reaction for a pre-determined time delay and changing a physical property of the mechanical restraining element;

(6) releasing restraint by the mechanical restraining element; and (7) triggering the wellbore device.

This general method summary may be augmented by the various elements described herein to produce a wide variety of invention embodiments consistent with this overall design description.

System/Method Variations

The present invention anticipates a wide variety of variations in the basic theme of oil and gas extraction. The examples presented previously do not represent the entire scope of possible usages. They are meant to cite a few of the almost limitless possibilities.

This basic system and method may be augmented with a variety of ancillary embodiments, including but not limited to:

An embodiment wherein said tool is conveyed with said wellbore casing.

An embodiment wherein said tool is deployed with a wireline tool.

An embodiment wherein said tool is deployed with TCP.

An embodiment wherein said tool is pumped down with a pump down tool.

An embodiment wherein the chemical change occurs at a pre-determined temperature expected to be encountered in the wellbore casing.

An embodiment wherein the pre-determined temperature ranges from 25° C.-250° C.

An embodiment wherein the reactive fluid is contained in a reservoir.

An embodiment wherein the reactive fluid is selected from a group comprising: fresh water, salt water, KCL, NaCl, HCL or hydrocarbons.

An embodiment wherein the stored energy is applied from a spring.

An embodiment wherein the stored energy is applied from a pressure from a fluid and a seal.

An embodiment wherein the stored energy is applied from a magnetic field.

An embodiment wherein the stored energy is applied from a weight.

An embodiment wherein the time delay ranges from 1 hour to 48 hours.

An embodiment wherein the time delay ranges from 2 days to 14 days.

An embodiment wherein the delay time ranges from 0.01 seconds to 1 hour.

An embodiment wherein the actuating device is a rupture disk; the rupture disk actuated by pressure in the wellbore casing.

An embodiment wherein the actuating device is an electronic switch; the electronic switch actuated by a signal from a device storing the stored energy.

An embodiment wherein the wellbore device is a firing pin; the firing pin actuated when the mechanical restraining element reacts with the reactive fluid and changes size.

An embodiment wherein the mechanical restraining element is a nut.

An embodiment wherein the wellbore device is a spool valve; the spool valve opens up a port when the mechanical restraining element reacts with the reactive fluid and changes size.

An embodiment wherein the mechanical restraining element is a tensile member.

An embodiment wherein the wellbore device is an electrical switch; the electrical switch enables a connection when the mechanical restraining element reacts with the reactive fluid and changes size.

An embodiment wherein the mechanical restraining element is a restrictive plug element.

An embodiment wherein the pre-determined time delay is determined by composition of the reactive fluids.

An embodiment wherein the pre-determined time delay is determined by reaction rate of the reactive fluids with the mechanical restraining element.

An embodiment wherein the pre-determined time delay is determined by reaction time of the reactive fluids with the mechanical restraining element.

An embodiment wherein the pre-determined time delay is determined by masking a contact area of the mechanical restraining element.

An embodiment wherein the pre-determined time delay is determined by masking a total area of the mechanical restraining element in contact with the mechanical restraining element.

An embodiment wherein a shape of the mechanical restraining element is selected from a group comprising: square, circle, oval, and elongated.

An embodiment wherein a material of the mechanical restraining element is selected from a group comprising: metal, non-metal, alloy.

An embodiment wherein the reactive fluid is wellbore fluid expected in the wellbore casing.

One skilled in the art will recognize that other embodiments are possible based on combinations of elements taught within the above invention description.

CONCLUSION

A time delay tool and method in a wellbore casing has been disclosed. The tool/method includes a mechanical restraining element, a reservoir for containing a reactive fluid, an actuating device and a wellbore device. When a stored energy is applied on the wellbore device, the actuation device is actuated and enables the reactive fluid in the reservoir to come in contact with the mechanical restraining element. While the mechanical restraining element undergoes a change in shape due to a chemical reaction, a stored energy applied on the wellbore device is delayed by a pre-determined time delay. The amount of the pre-determined time delay is determined by factors that include the reactive fluids, concentration of the reactive fluids, geometry and size of the mechanical restraining element.

What is claimed is:

1. A time delay method, the method using a wellbore time delay tool to delay action on a wellbore device, wherein the method comprises:

after positioning said wellbore tool in a wellbore casing, activating an actuating device to enable fluid communication between a mechanical restraining element and a reactive liquid such that a chemical reaction takes place between the mechanical restraining element and the reactive liquid, wherein the mechanical restraining element is directly attached to a firing pin of the wellbore device, the mechanical restraining element restrains the firing pin from moving, the reactive liquid is stored in a volume within the wellbore time delay tool, the reactive liquid causes a physical change in the mechanical restraining element, and the actuating device is located between the volume and the mechanical restraining element;

releasing the restraint of the mechanical restraining element on the firing pin of the wellbore device as a result of a time period of chemical reaction on the mechanical restraining element; and triggering the wellbore device as the firing pin moves due to a fluid pressure accumulated in the volume of the wellbore time delay tool.

2. The time delay method of claim 1 wherein the actuating device is a rupture disk and the step of activating the actuating device comprises bursting the rupture disk by a pressure in the wellbore casing.

3. The time delay method of claim 1 wherein the step of triggering the wellbore device includes moving a piston.

4. The time delay method of claim 1 wherein the step of triggering the wellbore device includes opening a port.

5. The time delay method of claim 1 wherein the step of triggering the wellbore device includes unplugging the wellbore device.

6. The time delay method of claim 1 wherein the step of triggering the wellbore device includes causing a rotational movement of the wellbore device.

7. The time delay method of claim 1 wherein the time period for the chemical reaction in the step of releasing is a time delay for the step of triggering the wellbore device, and the time delay is determined by a composition of the reactive liquid.

8. The time delay method of claim 1 wherein the time period for the chemical reaction in the step of releasing causes a time delay between the step of activating and the triggering of the wellbore device, and the time delay is determined by a reaction rate of the reactive liquid with said mechanical restraining element under downhole conditions.

9. The time delay method of claim 1 wherein the time period for the chemical reaction in the step of releasing causes a time delay between the step of activating and the triggering the wellbore device, the time delay determined by a reaction time of the reactive liquid with the mechanical restraining element.

10. The time delay method of claim 1 wherein the time period for the chemical reaction in the step of releasing causes a time delay between the step of activating and the triggering of the wellbore device, the time delay determined by an extent of a masking off of a potential contact area of the mechanical restraining element with the reactive liquid.

11. The time delay method of claim 1 the step of activating the actuating device includes using an electronic switch.

12. The time delay method of claim 1 wherein the step of activating the actuating device includes using a magnetic field.

13. The time delay method of claim 1 wherein the step of activating the actuating device includes using stored energy in a spring.

14. The time delay method of claim 1 wherein the step of activating the actuating device includes using stored energy of a weight.

15. A method of using a wellbore time delay tool to delay a triggered action on a wellbore device, the method of using the downhole time delay tool comprises the steps of:

after positioning the wellbore tool in a wellbore casing, rupturing a rupture disk to thereby enable fluid communication between a mechanical restraining element and a reactive liquid such that a chemical reaction takes place between the mechanical restraining element and the reactive liquid, wherein the mechanical restraining element is directly attached to a firing pin of the wellbore device, the mechanical restraining element restrains the firing pin from moving, the reactive liquid is stored in a volume within the wellbore time delay tool, the reactive liquid causes a physical change in the mechanical restraining element, and the rupture disk separates the volume from the mechanical restraining element;

releasing the restraint of the mechanical restraining element on the firing pin of the wellbore device as a result of a time period of chemical reaction on the mechanical restraining element; and triggering the wellbore device as the firing pin moves due to a fluid pressure accumulated in the volume of the wellbore time delay tool.

16. The method of claim 15, wherein the step of rupturing the rupture disk comprises rupturing with a pressure in the wellbore casing.

17. The method of claim 15 wherein the chemical reaction on the mechanical restraining element triggers the firing pin.

* * * * *